US012364898B2

(12) United States Patent
Kay et al.

(10) Patent No.: US 12,364,898 B2
(45) **Date of Patent: *Jul. 22, 2025**

(54) EXERCISE WEIGHT SUPPORT DEVICE ENHANCEMENTS

(71) Applicants: John Gordon Kay, Avon Lake, OH (US); Thomas John Slomka, North Royalton, OH (US); David Gilchrist Kay, Stacy, MN (US); Brian Richard Clark, Oberlin, OH (US)

(72) Inventors: John Gordon Kay, Avon Lake, OH (US); Thomas John Slomka, North Royalton, OH (US); David Gilchrist Kay, Stacy, MN (US); Brian Richard Clark, Oberlin, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/130,754

(22) Filed: Apr. 4, 2023

(65) Prior Publication Data

US 2023/0233898 A1 Jul. 27, 2023

Related U.S. Application Data

(63) Continuation of application No. 17/002,088, filed on Aug. 25, 2020, now Pat. No. 11,617,914.
(Continued)

(51) Int. Cl.

| | |
|---|---|
| ***A63B 21/078*** | (2006.01) |
| ***A63B 21/00*** | (2006.01) |
| ***A63B 21/072*** | (2006.01) |

(52) U.S. Cl.
CPC ..... *A63B 21/0783* (2015.10); *A63B 21/072* (2013.01); *A63B 21/0726* (2013.01);
(Continued)

(58) Field of Classification Search
CPC ..... A63B 21/072; A63B 21/0726; A63B 21/0724; A63B 21/0783; A63B 21/157; A63B 21/4035; A63B 2225/093; A63B 1/00; A63B 1/005; A63B 71/0054; A63B 71/0622; B60P 7/083; B60P 7/0838;
(Continued)

(56) References Cited

U.S. PATENT DOCUMENTS 7,503,736 B1 * 3/2009 Chen ..... B60P 7/083 410/100
9,884,239 B2 * 2/2018 Kay ..... A63B 71/0054
(Continued)

*Primary Examiner* — Megan Anderson
(74) *Attorney, Agent, or Firm* — David A. Burge; Benjamin D. Burge

(57) ABSTRACT

An exercise weight support device includes: a spool connected to a belt to suspend the device, the spool being rotatable to enable more or less of the belt to be wound therearound to change the vertical position of the device; a ratchet wheel drivingly coupled to the spool to control rotation thereof; an outer frame having a cradle and/or pair of hooks to support a bar of a free weight; a ratchet pawl connected to the outer frame at a fixed location relative thereto; and a trigger handle coupled to the spool to move the spool relative to the ratchet pawl between a non-operating position of the trigger handle causing the ratchet pawl and teeth of the ratchet wheel to engage, and an operating position of the trigger handle causing the ratchet pawl and teeth to disengage to control rotation of the spool.

17 Claims, 31 Drawing Sheets

Related U.S. Application Data

(60) Provisional application No. 62/891,399, filed on Aug. 25, 2019.

(52) U.S. Cl.
CPC ..... *A63B 21/157* (2013.01); *A63B 21/4035* (2015.10); *A63B 21/0724* (2013.01); *A63B 2225/093* (2013.01)

(58) Field of Classification Search
CPC ..... Y10T 24/2175; B25B 11/00; B25B 11/02; B66D 3/02
See application file for complete search history.

(56) References Cited

U.S. PATENT DOCUMENTS

| | | | | |
|---|---|---|---|---|
| 10,807,834 | B2 * | 10/2020 | Friessen | B66C 1/26 |
| 2014/0073493 | A1 * | 3/2014 | Parish | A63B 21/0724 482/104 |

* cited by examiner

EXERCISE WEIGHT SUPPORT DEVICE ENHANCEMENTS

REFERENCE TO PROVISIONAL APPLICATION

This application is a continuation of U.S. patent application Ser. No. 17/002,088 filed Aug. 25, 2020 by John Gordon Kay et al.; which claims the benefit of the filing date of, U.S. Provisional Application Ser. No. 62/891,399 filed Aug. 25, 2019 by John Gordon Kay et al.; the disclosures of each of which are incorporated herein by reference.

CROSS-REFERENCE TO OTHER RELATED APPLICATIONS

This application is related to U.S. Provisional Application Ser. No. 62/133,418 filed Mar. 15, 2015 by John Gordon Kay et al., the disclosure of which is incorporated herein by reference.

This application is also related to U.S. patent application Ser. No. 14/998,980 filed Mar. 11, 2016 by John Gordon Kay et al., now issued Feb. 6, 2018 as U.S. Pat. No. 9,884,239 (hereinafter referred to as "Kay et al."), the disclosure of which is incorporated herein by reference.

BACKGROUND

What is disclosed herein relates to the field of exercise devices—specifically to devices that protect a weightlifter when lifting free weights, such as a barbell or a pair of dumbbells, when assistance from a human spotter is unavailable.

As explained in Kay et al., weightlifting is enjoyed by millions of people in pursuit of better health and increased strength. Lifting free weights, such as barbells or a pair of dumbbells that are unconnected to any stationary structure, is widely regarded as a better form of weightlifting than using a weightlifting machine, because the weightlifter is free to use their normal range of movement for their body type when lifting. However, lifting free weights presents a greater variety of risks for personal injury to both the weightlifter and to others who may be in the vicinity of the weightlifter than does using a weightlifting machine.

However, as also explained in Kay et al., there is a wide variety of possible risks in lifting with free weights, including a greater variety of types of muscle strain involving a greater variety of muscles, as well as the possibility of dropping a barbell on a part of the weightlifter's body, including a foot or the neck. Another issue are the "pre-lift" lifting of weights from a rack or floor to a starting position from which the lifting exercise is to begin, and the "post-lift" lowering of weights back to the rack or floor, which when taken together, many weightlifters find requires more exertion than occurs during the actual lifting exercise, itself.

It is this greater variety of risks that long ago led to the introduction of an ever increasing variety of weightlifting machines. Generally, weightlifting machines increase safety by limiting the range of possible movement made by the weightlifter during the lifting exercise to little more than a single straight or gently arcing movement. This greatly simplifies the lifting exercise by relieving the weightlifter of having to exert additional energy to constrain the movement of weights in directions other than along the path of movement that is intended during the lifting exercise. Also, weightlifting machines generally eliminate the need for a weightlifter to engage in the "pre-lift" lifting of weights and the "post-lift" lowering of weights, thereby precluding occurrences of accidents during those phases. It is for these reasons that weightlifting machines are often viewed as a good option for novice weightlifters and/or individuals who only occasionally lift weights.

Unfortunately, while the imposition of such limits in movement by weightlifting machines may greatly increase safety, and while the elimination of the pre-lift and post-lift phases by weightlifting machines may be seen as positive benefits that even avid weightlifters may appreciate, those same imposed limits in movement are seen as having disadvantages. For example, although constraining the movement of weights in directions other than along the path of movement relieves a weightlifter from needing to exert additional energy to do so, this can remove the opportunity to develop other muscles than those strictly required to exert weightlifting force along that constrained path of movement. In other words, muscle development may become limited to only particular muscles such that some muscles in a part of the body may become markedly more developed than others in that same part of the body. It is this possible result that often causes avid weightlifters to choose free weights over weightlifting machines, and thereby accept the increased potential for accidents and injury.

As also explained in Kay et al., various efforts have been made by others to address the potential for injury and/or damage to property that may arise during weightlifting with free weights. However, such other efforts have given rise to various devices that suffer from various shortcomings, including not addressing the potential for injuries during one or more of the "pre-lift" lifting, the actual lifting exercise, and the "post-lift" lowering; and/or not being suited for use with one or the other of barbells and dumbbells.

Kay et al. discloses various embodiments of an exercise weight support device that improves upon such efforts by others in enabling the benefits of weightlifting with free weights to be enjoyed with greater safety and convenience. What is disclosed and claimed in this present application further improves upon such efforts.

SUMMARY

What is disclosed herein includes various embodiments of various enhancements to the exercise weight support device of Kay et al.

Among those improvements may be a more modular design that allows each exercise weight support device to be used interchangeably, either with or without various adapters, with a growing variety of free weights widely varying physical configurations that are designed to enable the selection of the amount of weight to be made in a manner that is more "user friendly" to weightlifters.

Among those improvements may be the addition of externally operable trigger controls that enable the vertical position of each exercise weight support device to be adjusted by grasping external portions of the outer frame and operating each of the externally operable trigger controls with a single digit of a hand.

Among those improvements may be the addition of an improved sheet-like bar wrap that provides weightlifters with an improved grip on the handles or portions of bars by which free weights are lifted.

BRIEF DESCRIPTION OF THE DRAWINGS

A fuller understanding of what is disclosed in the present application may be had by referring to the description and claims that follow, taken in conjunction with the accompanying drawings, wherein:

DETAILED DESCRIPTION

Figure 1A:
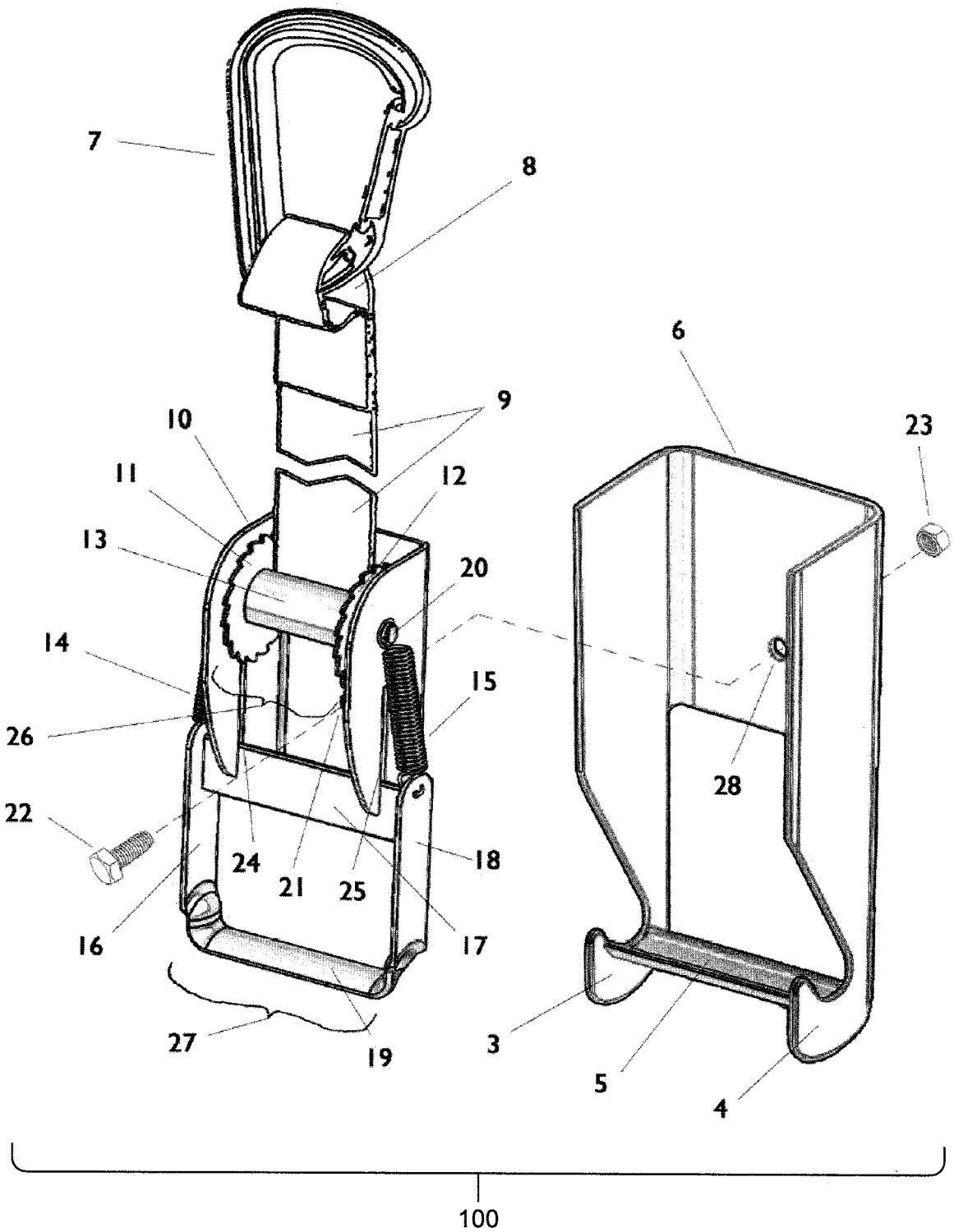
PRIOR ART FIG. 1A
FIG. 1A is a partially exploded view of a prior art exercise weight support device, showing features of an outer frame, a retracting reel mechanism within an inner frame, and a trigger handle.
Figure 1B:
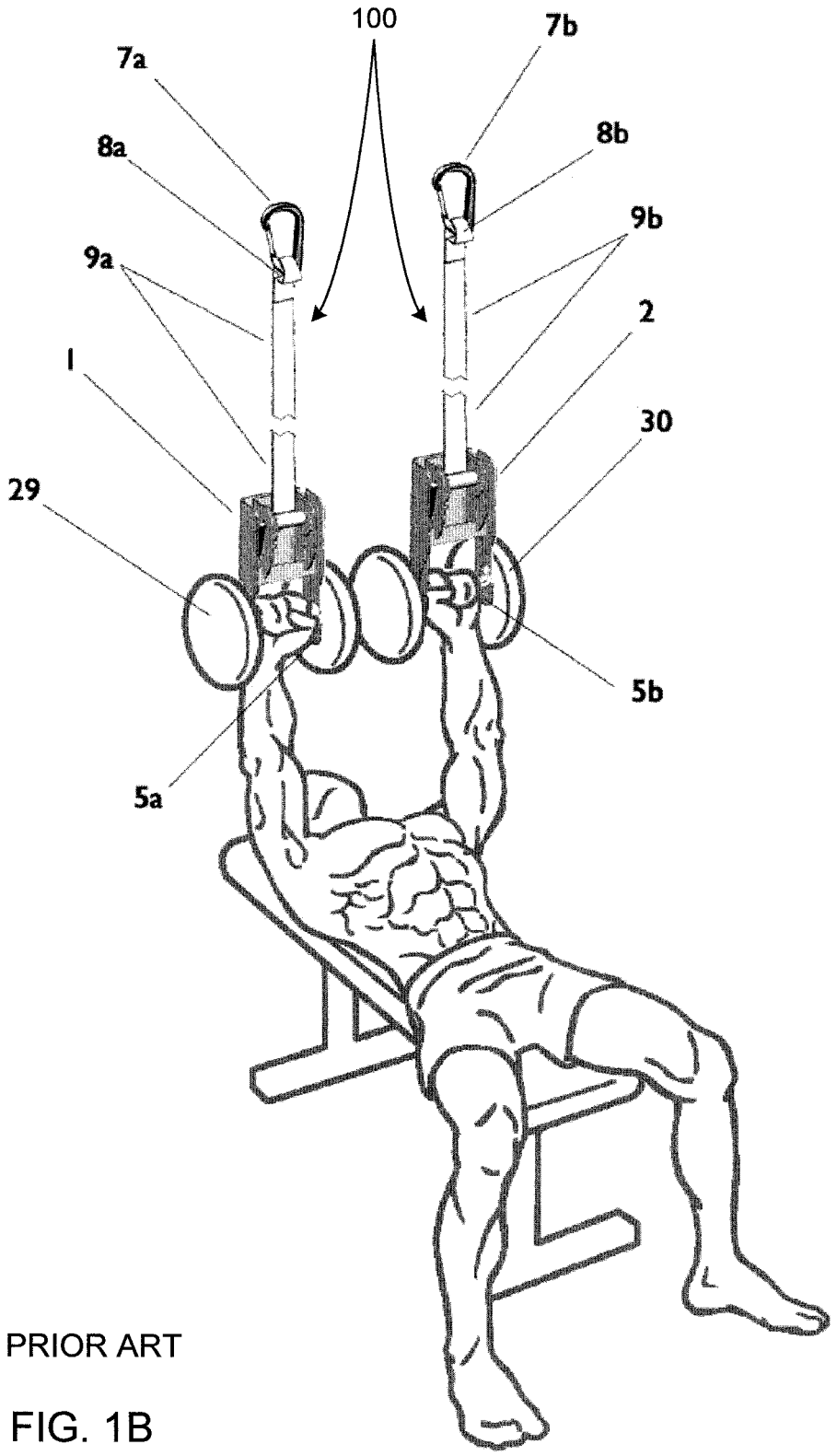
PRIOR ART FIG. 1B
FIGS. 1B and 1C are perspective views of example uses of two of the prior art exercise weight support devices of FIG. 1A.
Figure 1C:
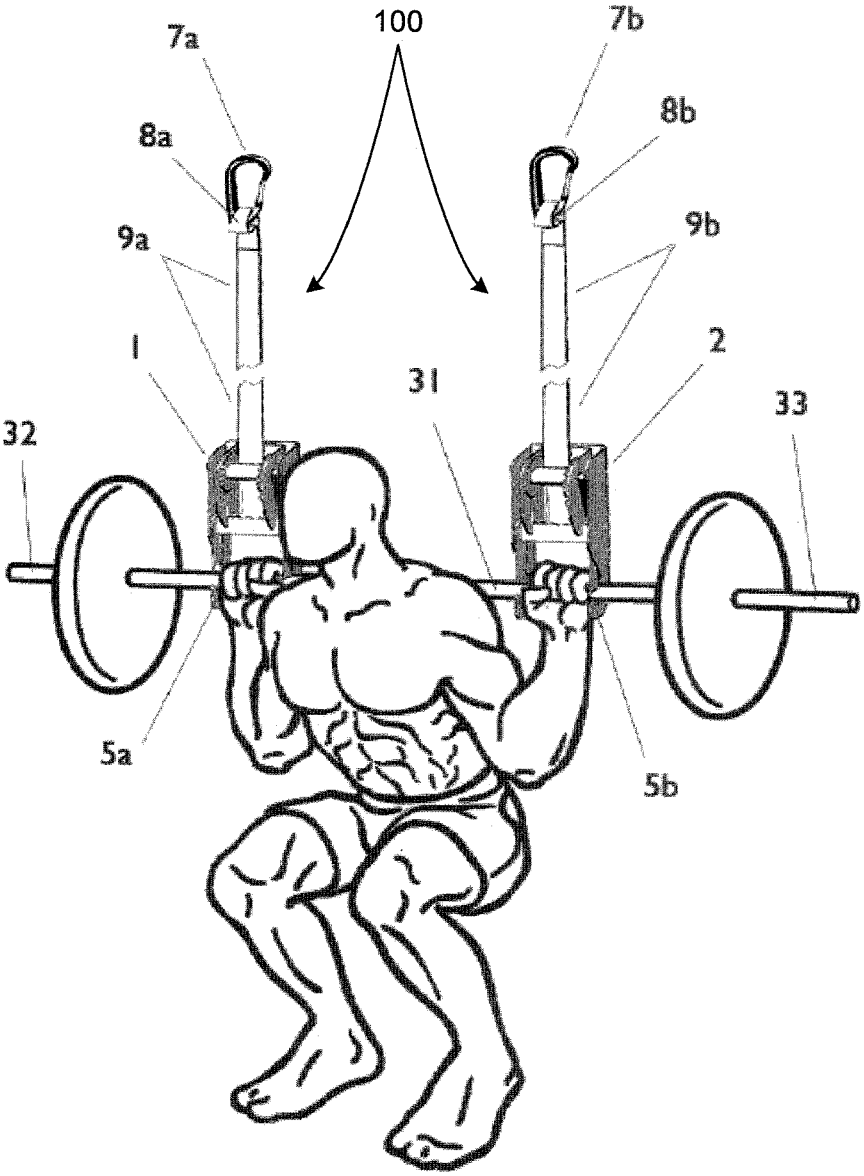
FIG. 1C PRIOR ART

Kay et al., and Associated Prior Art

FIGS. 1A through 1D, taken together, depict aspects of a prior art exercise weight support device 100 of Kay et al. More precisely, FIGS. 1A through 1D are based on a subset of the figures of Kay et al., specifically FIGS. 1, 4, 6B and 2B thereof. Additionally, FIGS. 1E and 1F, taken together, depict aspects of a later prior art variant 100' of the weight support device 100 of Kay et al.

Referring to FIGS. 1A-D, Kay et al. discloses the exercise weight support device 100 as including an outer frame 6 that includes a cradle 5 and accompanying pair of hooks 3 and 4 to support a portion of the bar of a dumbbell 29 or 30, or of a barbell 31. The outer frame 6 also carries an inner frame 10 that caries a retracting reel mechanism 26 that couples the exercise weight support device 100 to a belt 9. By being so coupled to the belt 9, the dumbbell 29 or 30, or part of the barbell 31 may be supported (e.g., by the depicted carabiner 7 that engages the depicted loop 8 formed in an upper end of the belt 9) by the exercise weight support device 100 from a portion of ceiling or other overhead structure of sufficient strength.

The inner frame 10 may be rigidly affixed to the outer frame 6 by one or more fasteners through aligned mounting holes, such as the depicted combination of nut 23 and bolt 22 extending through the depicted mounting hole 28 of the outer frame 6, and a corresponding unseen mounting hole 21 of the inner frame 10. Alternatively or additionally, the frames 6 and 10 may be affixed to each other in any of a variety of other ways, such as by being directly welded to each other, formed integrally with each other, etc.

The retracting reel mechanism 26 includes a spool 13 around which a lower end of the belt 9 may be wound, and that may be rotatably connected to the inner frame 10. The retracting reel mechanism 26 also includes a handle assembly 27 manually operable to control the retracting reel mechanism, and that may be slidably mounted to the inner frame 10 to permit a linear movement between operating and non-operating positions, such as by being guided through linear movement by the depicted pair of channels 24 and 25 formed in the inner frame 10. Thus, while the two frames 6 and 10 remain in a fixed positional relationship to each other, and while the axis about which the spool 13 rotates remains in a fixed positional relationship to both of the frames 6 and 10, the handle assembly 27 is movable relative to both of the frames 6 and 10 between the operating and non-operating positions.

The handle assembly 27 may include a trigger handle 19 flanked by handle portions 16 and 18. The trigger handle 19 extends down from the retracting reel mechanism 26 and into relatively close proximity to the cradle 5, the hooks 3 and 4, and the portion of the bar of whichever free weight 29, 30 or 31 may be supported thereby. This relatively close proximity of the trigger handle 19 to these other components 3, 4 and 5 puts the trigger handle 19 within reach of the digits of a hand of a weightlifter who is grasping the combination of the cradle 5 (between the hooks 3 and 4) and the portion of the bar of one of the free weights 29, 30 or 31. This enables operation of the trigger handle 19 using those digits while continuing to grasp the combination of the cradle 5 and the portion of the bar of one of the free weights 29, 30 or 31.

As is described more fully in Kay et al., the trigger handle 19 is operated by a weightlifter pulling it downward toward the cradle 5 (and the portion of the bar of one of the free weights 29, 30 or 31 that is supported atop and within the cradle 5). While the trigger handle 19 is not operated, it tends to be biased upwards into a non-operating position by one or more springs 14 and 15. With the trigger handle 19 in the non-operating position, a ratchet pawl 17 (also flanked by the handle portions 16 and 18, and directly guided in a linear motion by the channels 24 and 25) is caused to engage a pair of ratchet wheels 11 and 12 forming opposing ends of the spool 13, thereby causing the retracting reel mechanism 26 to act against the weight of whichever one of the free weights 29, 30 or 31 is currently being supported by preventing more of the belt 9 from being played out from the spool 13 such that the exercise weight support device 100 is prevented from being pulled downward. Stated differently, with the trigger handle 19 in the non-operating position, the current vertical position of whichever one of the free weights 29, 30 or 31 is currently being supported is maintained.

However, when the trigger handle 19 is pulled into its operating position as by being pulled downward toward the combination of the cradle 5 and the portion of the bar of one of the free weights 29, 30 or 31, and against the biasing force exerted by the one or more springs 14 and 15, the ratchet pawl 17 is pulled out of engagement with the ratchet teeth 11 and 12, thereby causing the retracting reel mechanism 26 to allow the belt 9 to be freely retracted onto the spool 13 as a weightlifter raises the combination of one of the free weights 29, 30 or 31 and the exercise weight support device 100. A torsion spring 20 incorporated into, or otherwise connected to, the spool 13 may bias the spool 13 toward rotating as needed to take in any slack that may develop in the belt 9 as the weightlifter raises the combination of the free weights 29, 30 or 31 and the exercise weight support device 100, thereby tending to keep the belt 9 taught to some degree. The pulling of the trigger handle 19 into the operating position also causes the retracting reel mechanism 26 to allow the belt 9 to be freely played out from the spool 13 as the weightlifter lowers that combination. Stated differently, while the trigger handle 19 is in the operating position, the weightlifter is able to perform their weightlifting exercise, and while in the non-operating position, the exercise weight support device 100 maintains a constant vertical position to support one of the free weights 29, 30 or 31 at that constant vertical position.

Thus, both the trigger handle 19 and the ratchet pawl 17 are attached to handle portions 16 and 18 such that they are caused to move in unison with each other. And thus, movement of the trigger handle 19 between the operating and non-operating positions causes movement of the ratchet pawl 17 out of engagement and into engagement, respectively, with the teeth of the ratchet wheels 11 and 12, thereby selectively preventing the rotational movement of the spool 13.

Figure 1D:
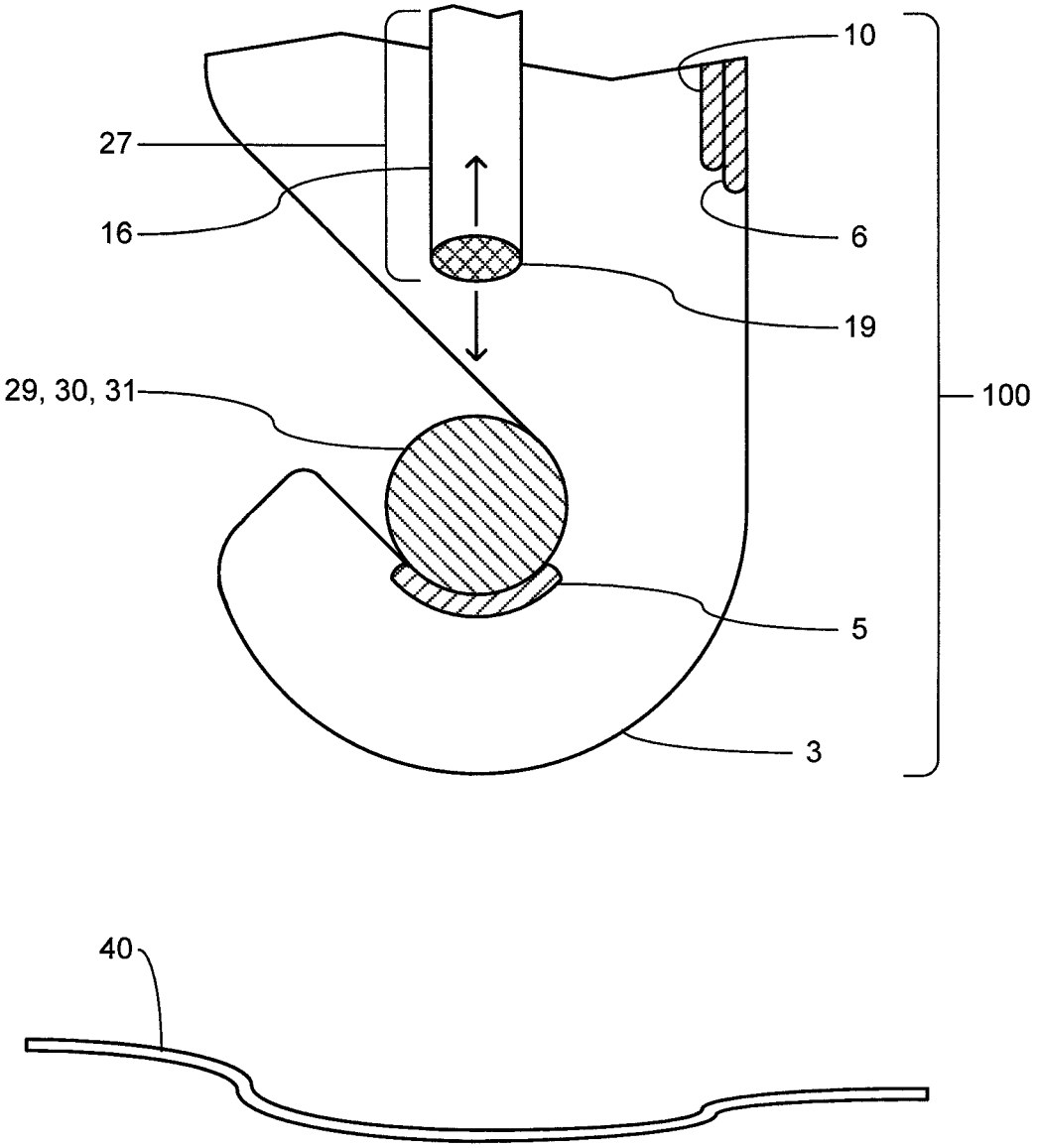
PRIOR ART FIG. 1D
FIG. 1D is a cross-sectional view of a portion of the prior art exercise weight support device of FIG. 1A, showing aspects of a sliding motion of the trigger handle between operating and non-operating positions.

Referring more specifically to FIG. 1D, Kay et al. also discloses a relatively simple sheet of hook and loop fastening material that may be wrapped around the combination of the cradle 5 and the portion of the bar of one of the free weights 29, 30 or 31 to provide a weightlifter with a better grip on that combination.

The reader is invited to refer to Kay et al. for a more detailed discussion and more complete depiction of the features and operation of the exercise weight support device 100 of Kay et al.

Improved Exercise Weight Support Device and Accessories of Present Application

Figure 2A:
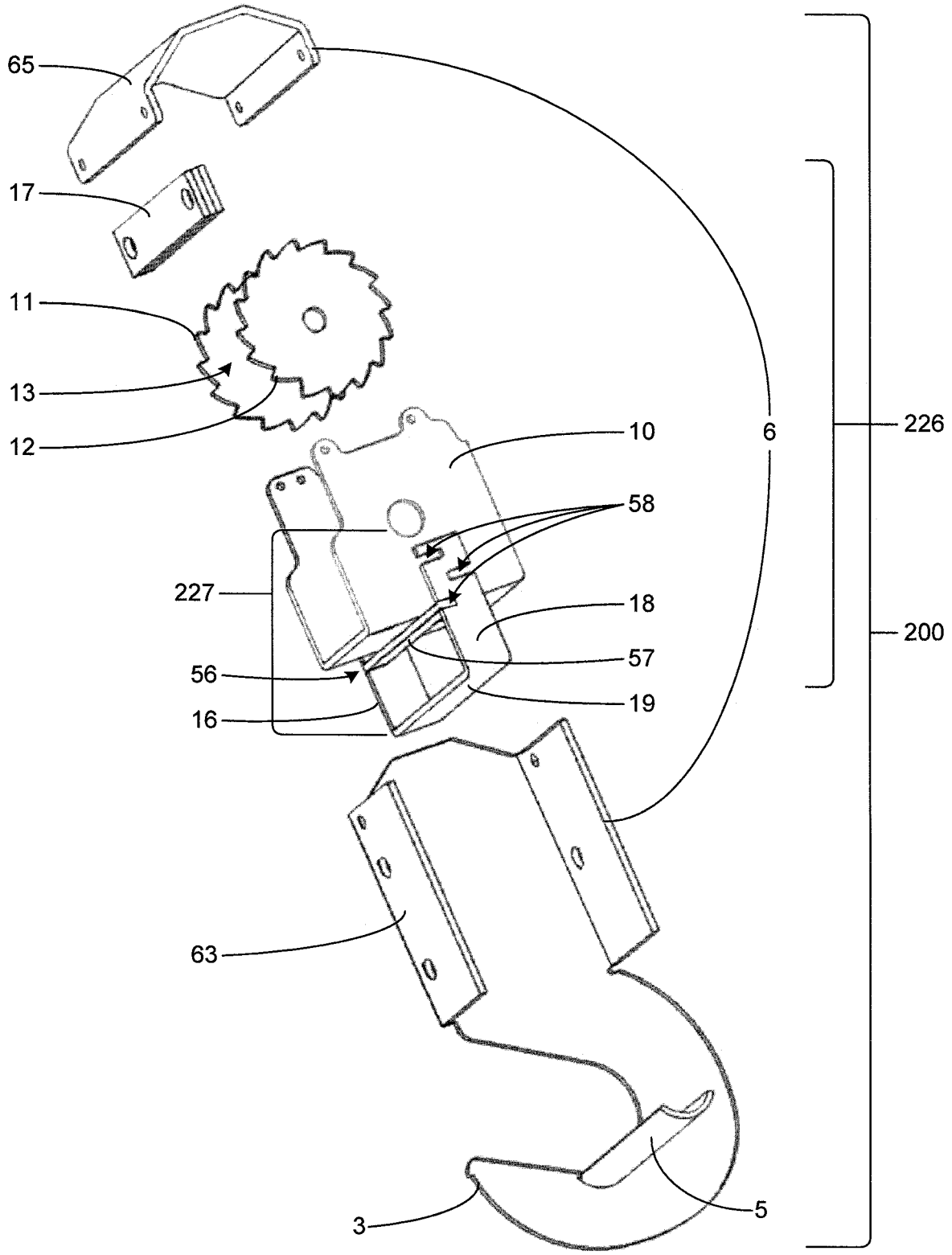
FIG. 2A is an exploded view of an example embodiment of an improved exercise weight support device, showing features of portions of an improved outer frame, an improved retracting reel mechanism within an improved inner frame, and an improved trigger handle.
Figure 2B:
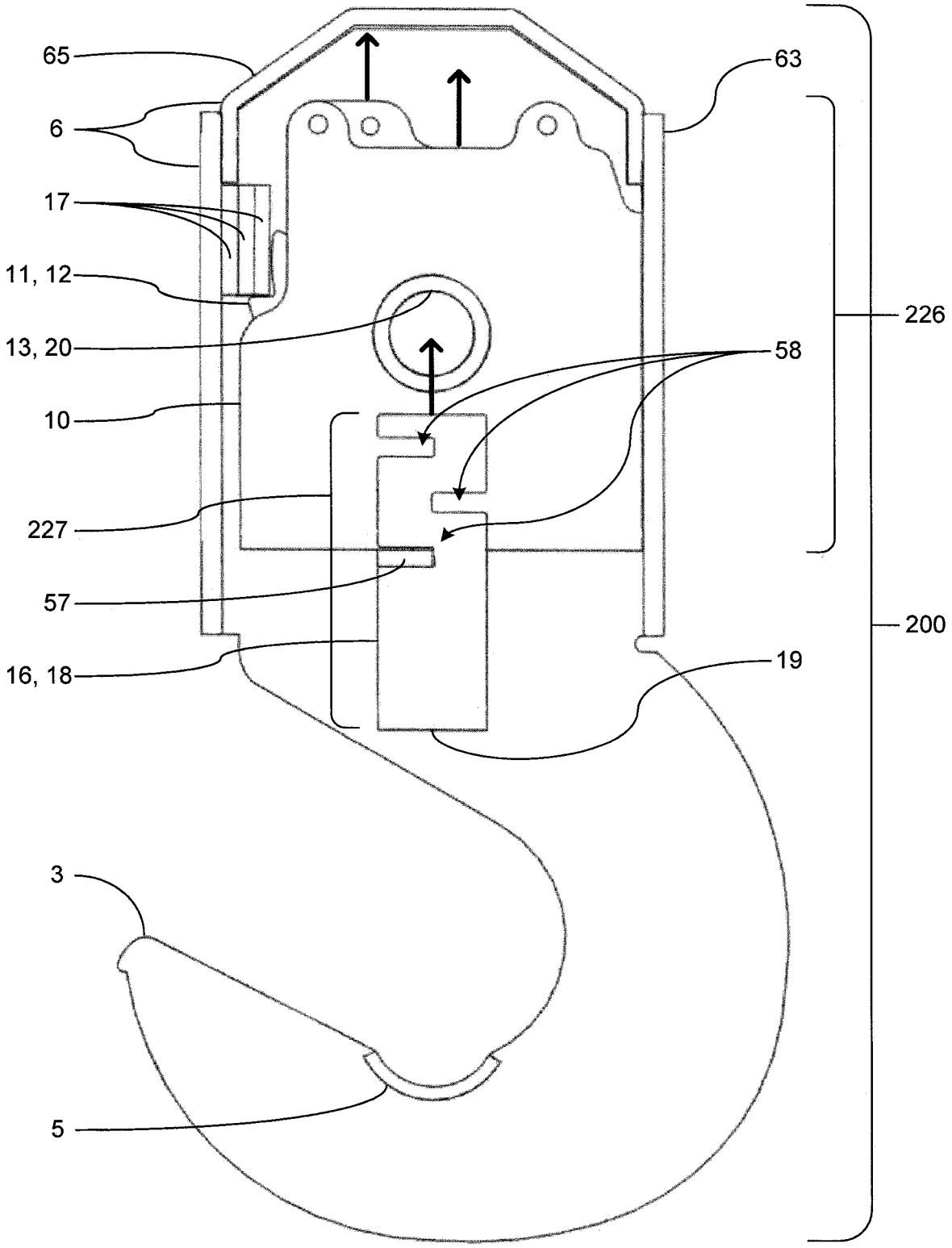
FIGS. 2B and 2C are side elevational views of the improved exercise weight support device of FIG. 2A, with a portion of the outer frame removed to show aspects of a sliding motion of a combination of the trigger handle, portions of the retracting reel mechanism and inner frame between operating and non-operating positions.
Figure 2C:
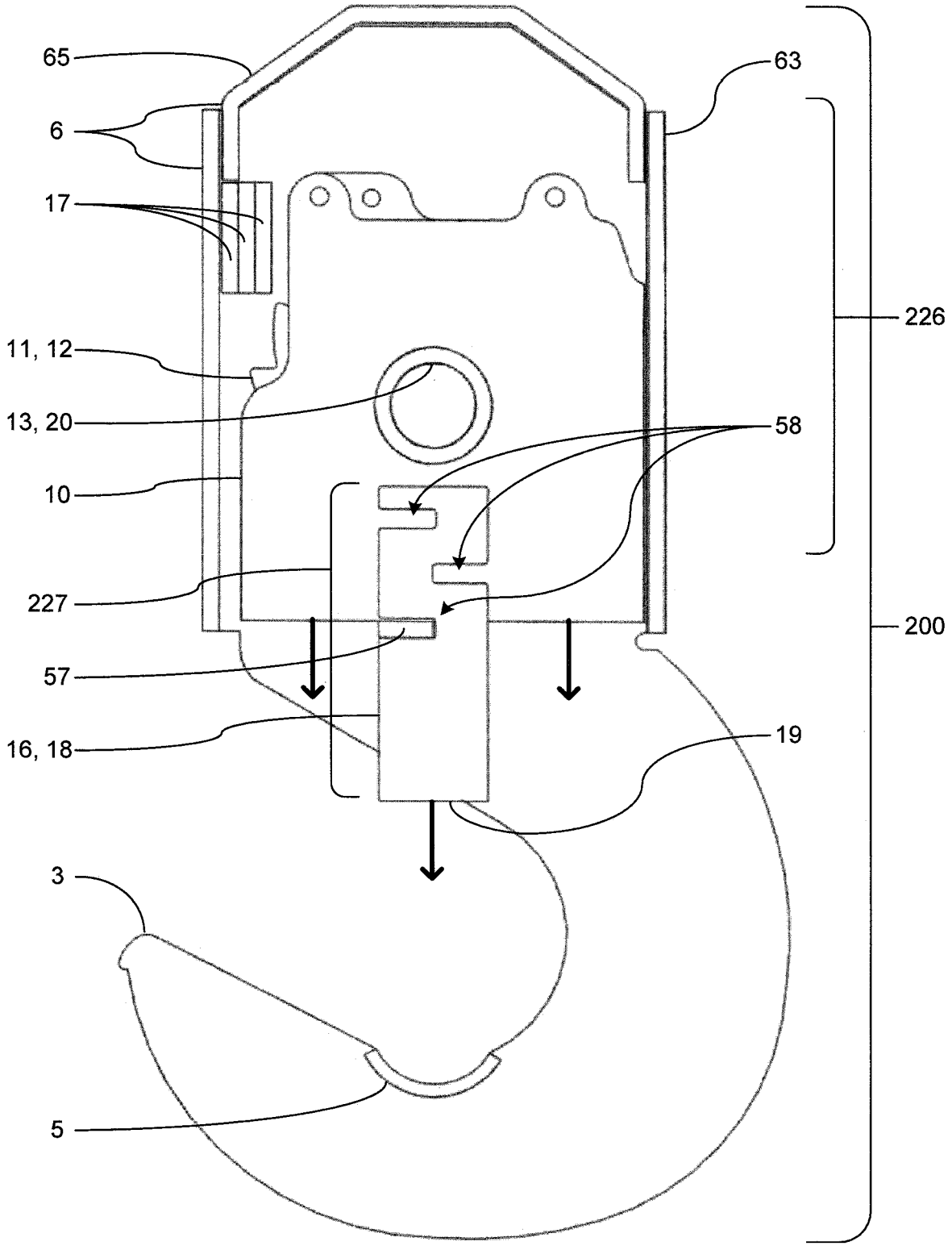
Figure 3A:
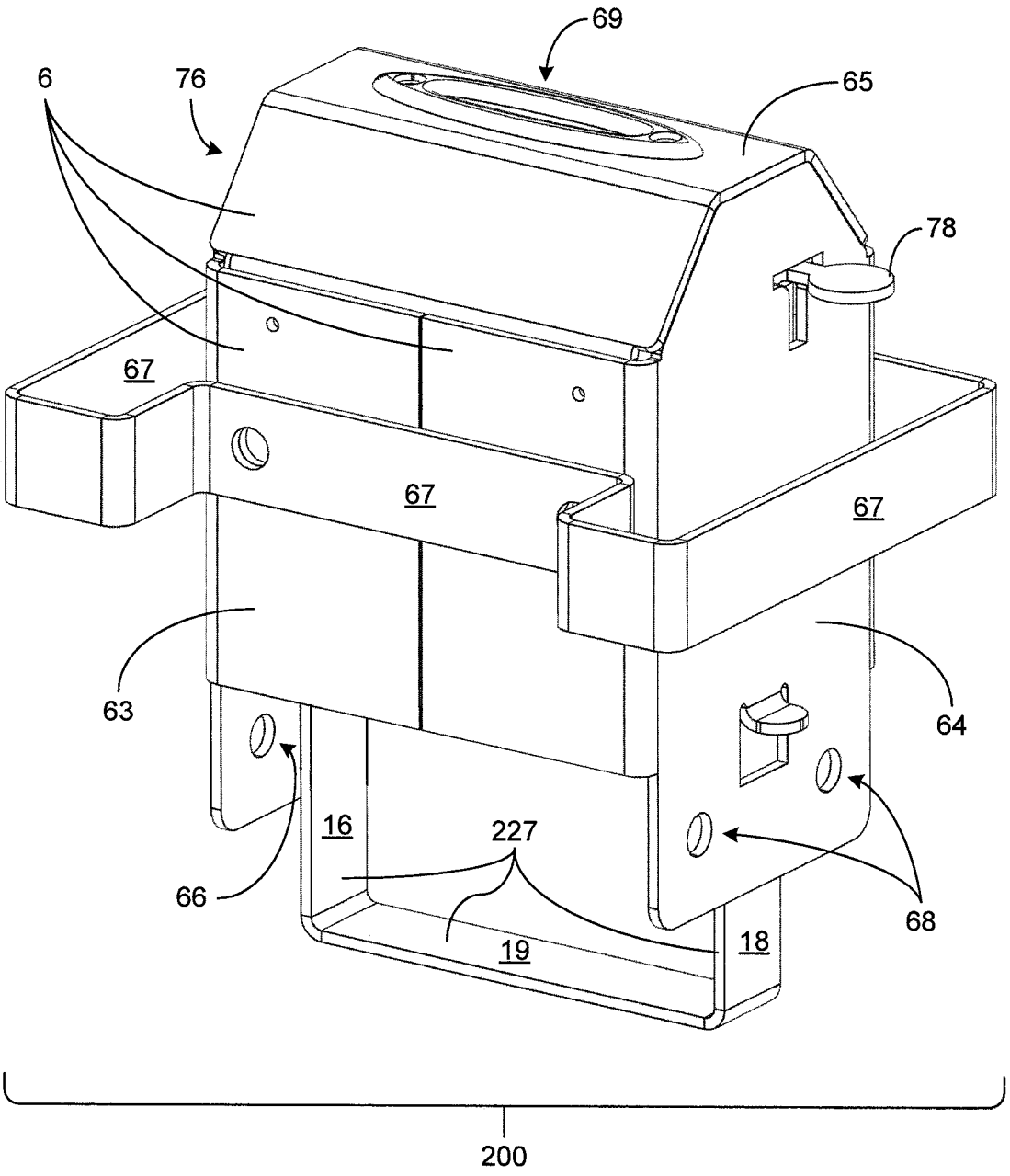
FIGS. 3A and 3B are perspective views of a example variation of the improved exercise weight support device of FIG. 2A, showing aspects of a variation of the improved outer frame thereof.
Figure 3B:
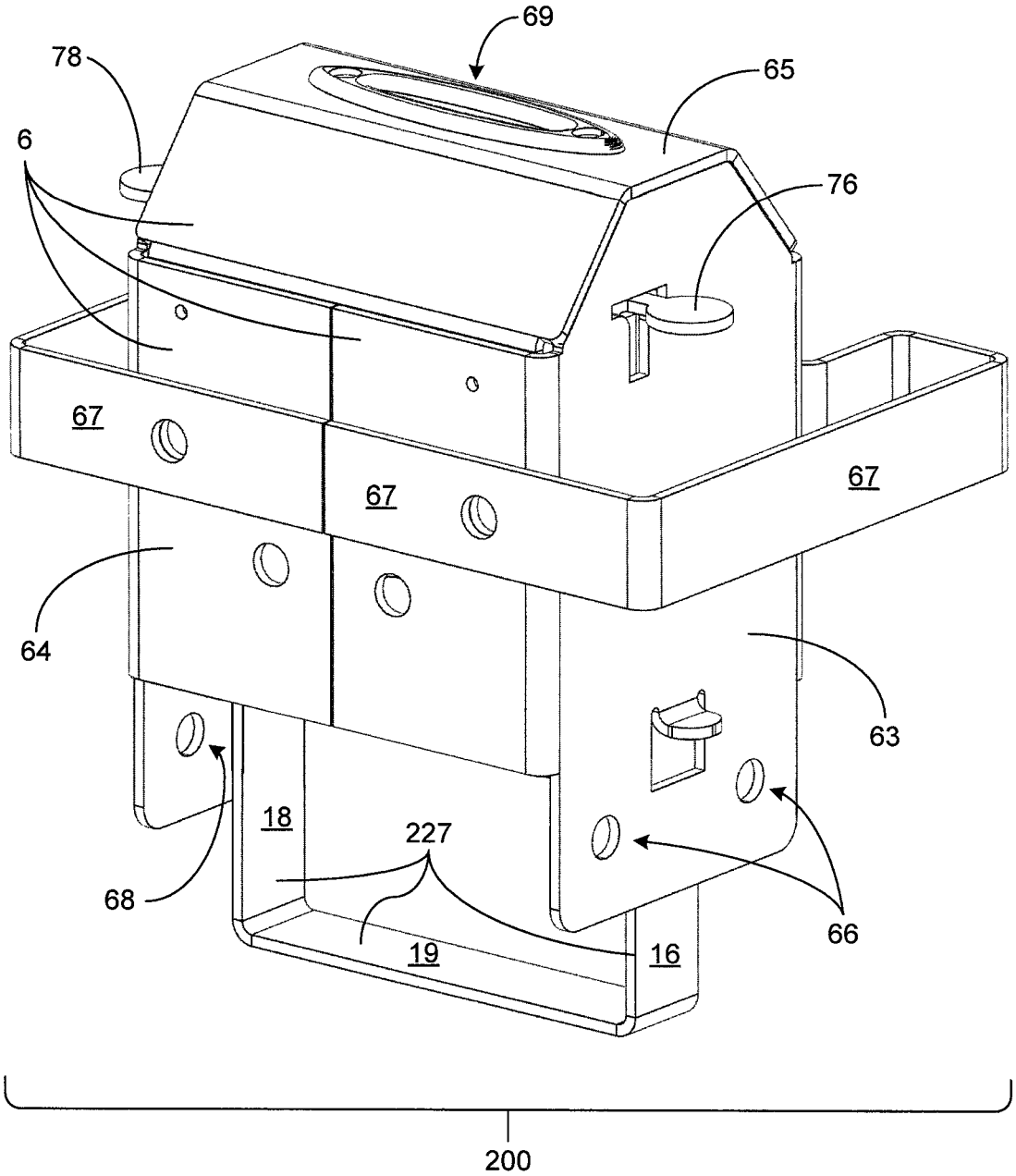
Figure 3C:
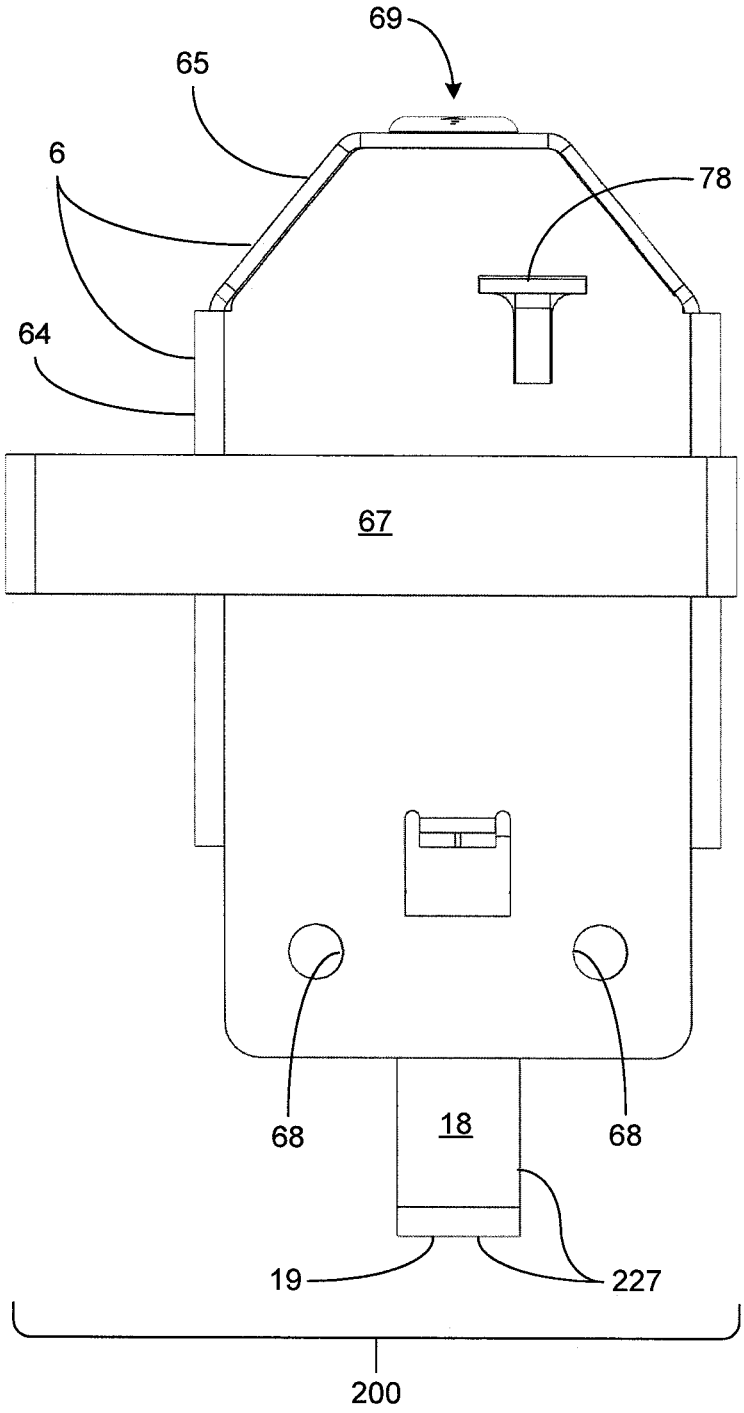
FIG. 3C is a side elevational view of the variation of improved exercise weight support device of FIGS. 3A-B.
Figure 3D:
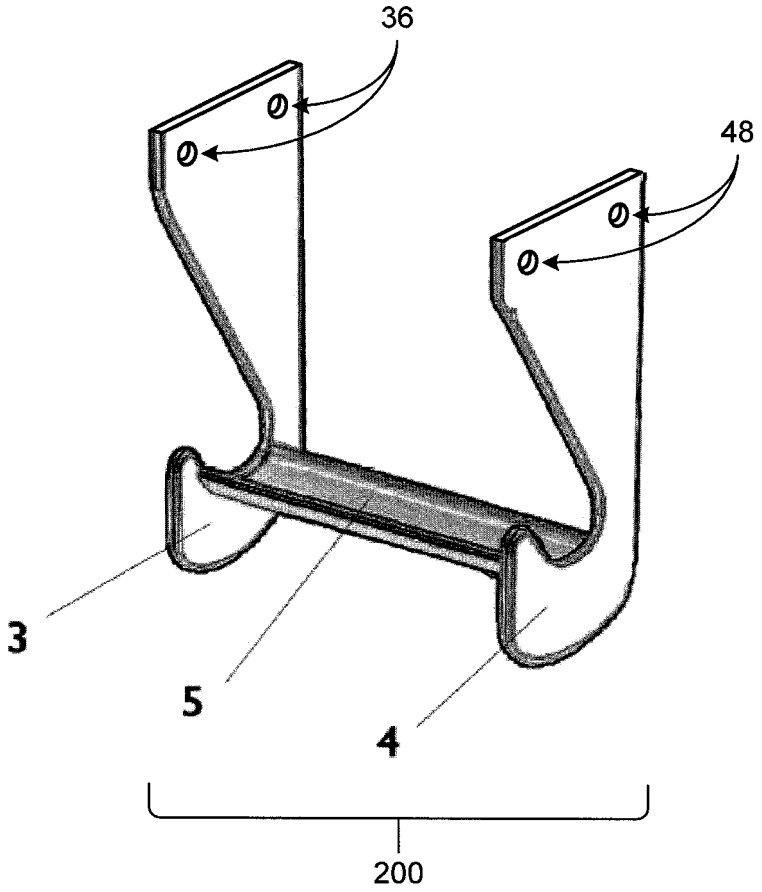
FIG. 3D is a perspective view of a detachable component of the variation of improved exercise weight support device of FIGS. 3A-C.

FIGS. 2A through 2C, taken together, depict aspects of an example embodiment of an improved exercise weight support device 200 incorporating various enhancements over the prior art exercise weight support device 100 of Kay et al. Also, FIGS. 3A through 3D, taken together, depict aspects of an alternate example embodiment of the improved exercise weight support device 200. It should be noted that where either of these embodiments of the improved exercise weight support device 200 includes components that correspond to components of the prior art exercise weight support device 100 of Kay et al., those corresponding components have been given identical reference numerals to those of the prior art exercise weight support device 100 of Kay et al. for sake of ease of understanding.

Referring to FIGS. 2A-C and 3A-D, like the prior art exercise weight support device 100 of Kay et al., both of the depicted embodiments of the improved exercise weight support device 200 of the present application incorporate an outer frame 6 that includes a cradle 5, and a pair of hooks 3 and 4. Also, similar to the prior art exercise weight support device 100 of Kay et al., both embodiments of the improved exercise weight support device 200 incorporate an inner frame 10 to which components of an improved retracting wheel mechanism 226 (which corresponds to the prior art retracting wheel mechanism 26 of the prior art exercise weight support device 100) are mounted. Further, like the prior art exercise weight support device 100 of Kay et al., both embodiments of the improved exercise weight support device 200 are operable to support a bar of a free weight (e.g., one of the aforedescribed free weights 29, 30 or 31) via the combination of the cradle 5, and the pair of hooks 3 and 4, from a ceiling or other overhead structure of sufficient strength to which the improved exercise weight support device 200 may be coupled via the belt 9. However, and as will shortly be explained in greater detail, the manner in which the components of both embodiments of the improved exercise weight support device 200 interact to control the rotation of the spool 13 to which the belt 9 is attached differ significantly from the manner in which corresponding ones of those components interact in the prior art weight support device 100 of Kay et al.

Referring to FIGS. 2A-C and 3A-D, while the outer frame 6 of the prior art exercise weight support device 100 of Kay et al. is of a largely open configuration (e.g., partially resembling a portion of C-channel or U-channel) allowing considerable external access to the inner frame 10 and prior art retracting wheel mechanism 26, the outer frame 6 of both of the depicted embodiments of the improved exercise weight support device 200 may be assembled from multiple pieces that cooperate to more fully enclose the inner frame 10 and improved retracting wheel mechanism 226. More specifically, the outer frame 6 of each of these two embodiments of the improved exercise weight support device 200 may be formed from a pair of side frame portions 63 and 64, and a top frame portion 65 that cooperate to so enclose the inner frame 10 and the improved retracting wheel mechanism 226. A distinct belt slot 69 may be formed through the top frame portion 65 to allow the belt 9 to pass therethrough.

Also, in each of these two embodiments, the side frame portions 63 and 64 may be formed to be identical, but mirror images, to each other.

However, the pair of hooks 3 and 4 may be selectively attachable to the side frame portions 63 and 64, respectively, in the embodiment of FIGS. 3A-D, while the pair of hooks 3 and 4 may be formed integrally with the side frame portions 63 and 64, respectively, in the embodiment of FIGS. 2A-C (in which only the side frame portion 63 formed integrally with the hook 3 is specifically shown). More precisely, in the embodiment of the improved exercise weight support device 200 of FIGS. 3A-D, the combination of the pair of hooks 3 and 4, with the cradle 5 extending therebetween (and which may be formed integrally with the hooks 3 and 4), may be selectively attachable to the pair of side frame portions 63 and 64, respectively, through the use of fasteners (e.g., nuts and bolts, pins, rivets, etc.) extending through aligned pairs of holes 36 and 66, and aligned pairs of holes 48 and 68. Such an ability to selectively attach the combination of the pair of hooks 3 and 4, along with the cradle 5, may be deemed desirable as an approach to enable use with an ever wider variety of free weights through use of an adapter or other hardware components as will shortly be explained in greater detail.

Referring to FIGS. 2A-C, while the inner frame 10 of the prior art exercise weight support device 100 of Kay et al. is affixed to an interior surface of the outer frame 6 such that the inner frame 10 and the outer frame 6 are caused to not move relative to each other, the inner frame 10 and the outer frame 6 of at least the embodiment of the improved exercise weight support device 200 of FIGS. 2A-C may be slidably connected to each other in a manner that enables relative movement therebetween along a linear path. More specifically, the inner frame 10 and the outer frame 6 of the improved exercise weight support device 200 of FIGS. 2A-C may be coupled by through-hole fasteners (e.g., nuts and bolts, rivets, pins, etc.), by track and/or groove components, and/or by any of a variety of other forms of mechanical coupling in a manner that enables the inner frame 10 to slide relative to the outer frame 6 along a linear path within the interior of the outer frame 6. Still more specifically, with the improved exercise weight support device 200 of FIG. 2A-C suspended by the belt 9 to a ceiling or other overhanging structure of sufficient strength, the linear path along which the inner frame 10 and the outer frame 6 are able to slide relative to each other may be oriented vertically. The same mechanical coupling by such relative sliding movement is enabled may also incorporate one or more mechanical stops of any of a variety of configurations that serve to limit the extent of the movement of the inner frame 10 within the interior of the outer frame 6. Alternatively or additionally, one or more portions of the outer frame 6, itself (e.g., an interior surface of the top frame portion 65), may serve to provide at least one of such mechanical stops.

Unlike the trigger handle 19 of the prior art handle assembly 27 of the prior art exercise weight support device 100 of Kay et al., the trigger handle 19 of the improved handle assembly 227 of at least the embodiment of the improved exercise weight support device 200 of FIGS. 2A-C is adjustable in its positions relative to the cradle 5 in both its operating and not-operating positions to accommodate bars of differing diameters of a wider variety of free weights. More specifically, while the trigger handle 19 of both the prior art handle assembly 27 and the improved handle assembly 227 are flanked by handle portions 16 and 18, the handle portions 16 and 18 of the improved handle assembly 227 may each additionally incorporate a set of notches 56 and 58, respectively (of which the notches 58 are visible), by which each of the handle portions 16 and 18 may be coupled to a crossbar 57 at different locations along their lengths. As a result, the distance between the trigger handle 19 and the cradle 5, in both operating and non-operating positions are made adjustable to enable the operating handle 19 to continue to be made reachable with the finger tips of a hand of a weightlifter, even as bars of differing diameters are supported atop and within the cradle 5. The crossbar 57, in turn, is either mechanically fixed to the inner frame 10 (e.g., by one or more fasteners, by welding thereto, etc.), or is formed integrally with the inner frame 10. Thus, upon being mechanically coupled by a selected pair of the notches 56 and 58, the trigger handle 19 of the improved handle assembly 227 becomes mechanically coupled via the handle portions 16 and 18, respectively, to the inner frame 10.

As previously discussed, in the prior art retractable reel mechanism 26 of the prior art exercise weight support device 100 of Kay et al., the spool 13 around which the bottom end of the belt 9 may be wrapped may be rotatably mounted to the inner frame 10 such that it rotates about an axis that does not move relative to either of the inner frame 10 or the outer frame 6. Again, a principle feature of the prior art exercise weight support device 100 of Kay et al. is that the outer frame 6 and the inner frame 10 are mechanically affixed to each other such that they do not move relative to each other. As also previously discussed, in the prior art retractable reel mechanism 26, it is the ratchet pawl 17 that is mechanically linked to the prior art handle assembly 27. Again, another principle feature of the prior art weight support device 100 of Kay et al. is that the ratchet pawl 17 is movable relative to both of the frames 6 and 10. Thus, in the prior art retractable reel mechanism 26, movement of the trigger handle 19 relative to the frames 6 and 10 between the operating and non-operating positions causes corresponding movement of the pawl 17 out of engagement and into engagement, respectively, with the teeth of the ratchet wheels 11 and 12 that are mechanically linked for rotation with the spool 13 about the axis of the spool 13. More specifically, when the trigger handle 19 of the handle assembly 27 is not pulled downward (or "squeezed") toward the cradle 5 as by grasping the trigger handle 19 and moving it closer to the cradle 5, the ratchet pawl 17 is allowed to be urged by the one or more springs 14 and 15 (and/or by another elastic component, not shown) into engagement with the teeth of the ratchet wheels 11 and 12. However, when the trigger handle 19 is so pulled downward toward the cradle 5, the ratchet pawl 17 is pulled out of engagement with the teeth of the ratchet wheels 11 and 12.

In contrast, in the improved retractable reel mechanism 226 of at least the embodiment of the improved exercise weight support device 200 of FIGS. 2A-C, the spool 13 around which the bottom end of the belt 9 may be wrapped may be rotatably mounted to the inner frame 10 such that it rotates about an axis that moves with the inner frame 10 relative to the outer frame 6 as the inner frame 10 is slidably moved along the aforedescribed linear path within the interior of the outer frame 6. Again, a principle difference of the embodiment of the improved exercise weight support device 200 of FIGS. 2A-C from the prior art exercise weight support device 100 of Kay et al. is that the inner frame 10 in the improved exercise weight support device 200 is not connected in a fixed manner to the outer frame 6, which allows the inner frame 10 to move relative to and within the outer frame 6. Also, in the improved retractable reel mechanism 226, the pawl 17 may be directly or indirectly affixed to an interior portion of the outer frame 6 (e.g., by one or more through-hole fasteners, by any of a variety of other forms of hardware therebetween, by being welded thereto, by being formed integrally therewith, etc.) such that the pawl 17 does not move relative to the outer frame 6. It is therefore another principle difference of the improved retractable reel mechanism 226 from the prior art retractable reel mechanism 26 is that the ratchet pawl 17 does not move relative to the outer frame 6 in response to any movement of the trigger handle 19. Instead, in the improved retractable reel mechanism 26, all of the spool 13, the ratchet wheels 11 and 12, the inner frame 10 and the handle assembly 27 slidably move in unison relative to the outer frame 6 when the trigger handle 19 is moved (or "squeezed") toward the cradle 5. Thus, in the improved retractable reel mechanism 226, movement of the trigger handle 19 relative to the outer frame 6 between the operating and non-operating positions causes corresponding movement of the inner frame 10, and in turn, causes corresponding movement of the teeth of the ratchet wheels 11 and 12 out of engagement and into engagement, respectively, with the pawl 17.

FIG. 2B depicts the improved ratchet mechanism 226 in a state in which the trigger handle 19 of the improved handle assembly 227 is not pulled downward relative to the outer frame 6 (or "squeezed") toward the cradle 5 such that the trigger handle 19 is allowed to remain in its non-operating position. As a result, the inner frame 10 is allowed to be retained by one or more springs and/or another elastic component (not shown) at a vertically higher location within the outer frame 6 that cause the teeth of the ratchet wheels 11 and 12 to be engaged with the ratchet pawl 17.

It should be noted, however, it may not be necessary to employ one or more springs and/or another elastic component to cause the inner frame 10 to be retained at a vertically higher location within the outer frame 6 when the trigger handle 19 is allowed to remain in its non-operating position. As a result of the inner frame 10 being allowed to move in a linear sliding motion within the outer frame 6, as a result of that linear sliding motion becoming a vertical sliding motion when the improved exercise weight support device 200 is suspended from a ceiling or other sufficient overhead structure by the belt 9 that is wrapped around the spool 13, and as a result of the spool 13 being rotatably mounted to the inner frame 10, the outer frame 6 is caused to be supported by the inner frame 10 when the improved exercise weight support device 200 is suspended by the belt 9. This allows the force of gravity to act upon the outer frame 6 such that the outer frame 6 is caused to be pulled down relative to the inner frame 10, thereby causing upward sliding movement of the inner frame 10 within the outer frame 6, which in turn, causes the teeth of the ratchet wheels 11 and 12 to become engaged with the ratchet pawl 17. Thus, when the trigger handle 19 is not moved out of its non-operating position, the force of gravity acting on the outer frame 6 may be sufficient to cause the engagement between the ratchet pawl 17 and the ratchet wheels 11 and 12 that is needed to restrict rotation of the spool 13 such that more of the belt 9 is prevented from being played out from the spool 13, and thus, the improved exercise weight support device 200 is caused to maintain its vertical position relative to the ceiling or other overhanging structure from which it is suspended.

FIG. 2C depicts the improved ratchet mechanism 226 in a state in which the trigger handle 19 of the improved handle assembly 227 is pulled downward (or "squeezed") toward the cradle 5 and into its operating position. As a result, the inner frame 10 is slidably moved within and relative to the outer frame 6, thereby pulling the teeth of the ratchet wheels 11 and 12 out of engagement with the ratchet pawl 17.

It should be noted that, while it may be possible to dispense with the use of springs and/or other elastic components to maintain the trigger handle 19 in its non-operating position while it is not being acted upon to move it into its operating position, it may still be deemed desirable to incorporate a torsion spring 20 into the spool 13 (or otherwise couple a torsion spring to the spool 13) to bias the spool 13 towards rotating in a direction that tends to wind more of the belt 9 onto the spool 13. In this way, at times when the trigger handle 19 is in its operating position such that the teeth of the ratchet wheels 11 and 12 are no longer engaged by the pawl 17, thereby allowing the spool 13 to rotate more freely, slack that develops in the belt 9 each time a weightlifter moves the improved exercise weight support device 200 upwards during their lifting exercise will be taken up by the spool 13. This serves to ensure that the belt 9 remains taught throughout their lifting exercise such that it remains possible for the weightlifter to cause the improved exercise weight support device 200 to remain in whatever vertical position it is in at any time during the lifting exercise by simply releasing the trigger handle 19 such that the trigger handle 19 is allowed to return to its non-operating position.

An advantage of the improved retracting reel mechanism 226 of the improved exercise weight support device 200 over the prior art retracting reel mechanism 26 of the prior art exercise weight support device 100 of Kay et al. is that, in the improved retracting reel mechanism 226*k*, the fact that 1) the spool 13 is connected to the belt 9, 2) the spool is rotatably mounted on the inner frame 10 such that its axis of rotation does not move relative to the inner frame 10, 3) the inner frame 10 is connected to the trigger handle 19 such that the inner frame 10 and the trigger handle 19 do not move relative to each other, 4) the outer frame 6 is slidably connected to the inner frame 10 such that the two frames 6 and 10 are able to move vertically relative to each other, and 5) the outer frame 6 carries the weight of whatever free weights are used with the improved exercise weight support device 200 means that a weightlifter must necessarily begin lifting whatever free weights are used with the improved exercise weight support device 200 as part of pulling the trigger handle 19 toward the cradle 5 to cause the teeth of the ratchet wheels 11 and 12 to cease to engage the ratchet pawl 17. Stated differently, the act of "pulling" the trigger handle 19 downward relative to the outer frame 6 and into its operating position relative necessarily includes moving the outer frame 6 vertically upward by the weightlifter such that whatever free weights are used with the improved exercise weight support device 200 must also necessarily be moved upward by the weightlifter along with the outer frame 6. This may prove to be an important safety feature in that the weightlifter is forced to discover whether or not he or she is capable of lifting the amount of weight that they have chosen to lift before such a disengagement of the teeth of the ratchet wheels 11 and 12 with the ratchet pawl 17 can take place. Without the weightlifter being forced to actually begin lifting that amount of weight before the teeth of the ratchet wheels 11 and 12 can be pulled away from and disengaged from the ratchet pawl 17, the weightlifter might otherwise be put into a situation in which they've discovered they've made a mistake by trying to lift more weight than they are actually capable of lifting, which may result in any of a variety of weight lifting injuries.

Referring to FIGS. 3A-D, unlike prior art exercise weight support device 100 of Kay et al., at least the embodiment of the improved exercise weight support device 200 of FIGS. 3A-D may additionally carry one or more handles 67, and/or may be additionally operable via a pair of externally operable trigger controls 76 and 78 in lieu of operating the trigger handle 19. Each of the trigger controls 76 and 78 may be operable with a single digit of a hand that may simultaneously grasp the outer frame 6 via a handle 67. As will become evident in the succeeding figures of the present application, the more thoroughly enclosing configuration of the outer frame 6 of at least embodiment of the improved exercise weight support device 200 of FIGS. 3A-D, coupled with the use of adapters and/or other hardware components to support the use of a wider variety of free weights (e.g., free weights beyond the more traditional configurations of the earlier depicted dumbbells 29 and 30, or of the earlier depicted barbell 31), may render access to the trigger handle 19 more difficult at times other than when weightlifting exercises are actually being performed. The addition of the externally operable trigger controls 76 and 78 provide an alternative for controlling the improved retracting reel mechanism 226 at such other times to effect vertical positioning of the combination of the improved exercise weight support device 200 and a free weight supported thereby prior to actual performance of a weightlifting exercise. More specifically, each of the trigger controls 76 and 78 may be mechanically affixed to the inner frame 10 (e.g., through a vertical slot formed through the outer frame 6, as depicted for the trigger control 78) such that the trigger controls 76 and 78 may be operable to cause the aforedescribed vertical sliding movement of the inner frame 10 within the outer frame 6 that is needed to cause the teeth of the ratchet wheels 11 and 12 to be pulled out of engagement with the ratchet pawl 17, just as would be the case if the trigger handle 19 were moved from to its operating position. Still more specifically, with the trigger controls 76 and 78 so mechanically linked to the inner frame 10, the act of pulling either of the trigger controls 76 and 78 downward relative to the outer frame 6 and toward the handle 67 performs the same function as the act of pulling the trigger handle 19 downward relative to the outer frame 6 and into its operating position. Thus, the trigger control 78 is depicted in each of FIGS. 3A-C in a non-operating position that is equivalent to the aforedescribed non-operating position of the trigger handle 19, and pulling the trigger control 78 downward toward the handle 67 is pulling the trigger control 78 into an operating position that is equivalent to the aforedescribed operating position of the trigger handle 19.

FIGS. 4A through 4D, taken together, depict aspects of an example embodiment of an adapter 300 to adapt free weights of a plate-like configuration (e.g., free weights that lack a bar that can be supported by the combination of the cradle 5 and the pair of hooks 3 and 4) for use with at least the embodiment of the improved exercise weight support device 200 of FIGS. 3A-D. More specifically, and by way of example, the various components of the adapter 300 may be shaped and/or sized to serve as a mechanism by which at least the generally rectangular, and relatively small IRONMASTER® plate like weights 390 offered by Ironmaster LLC of Monroe, Washington, USA can be used with the improved exercise weight support device 200.

Figure 4A:
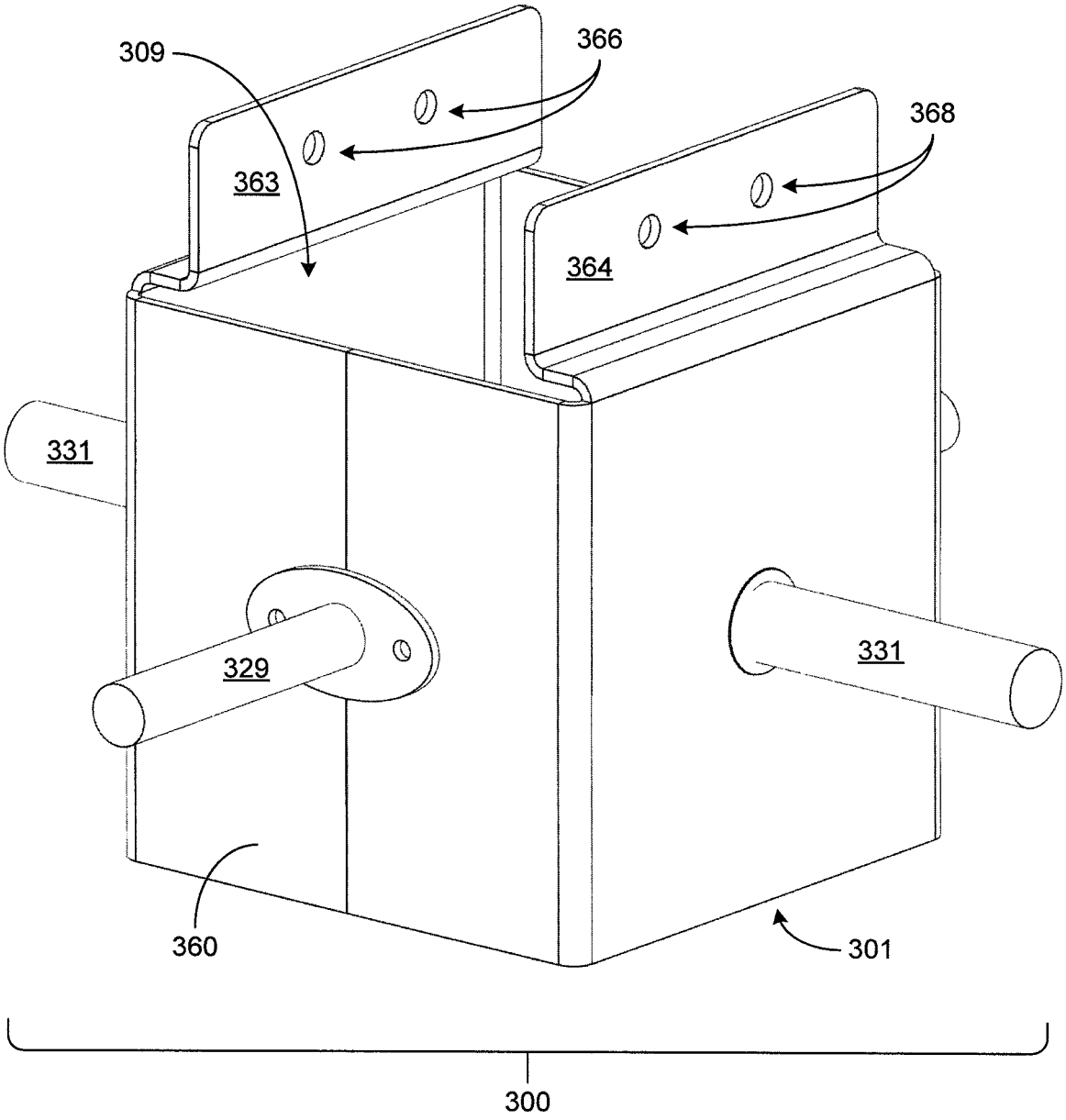
FIGS. 4A, 4B and 4C are perspective views of an adapter to adapt free weights of a plate-like configuration for use with at least the variant of improved exercise weight support device of FIGS. 3A-D.
Figure 4B:
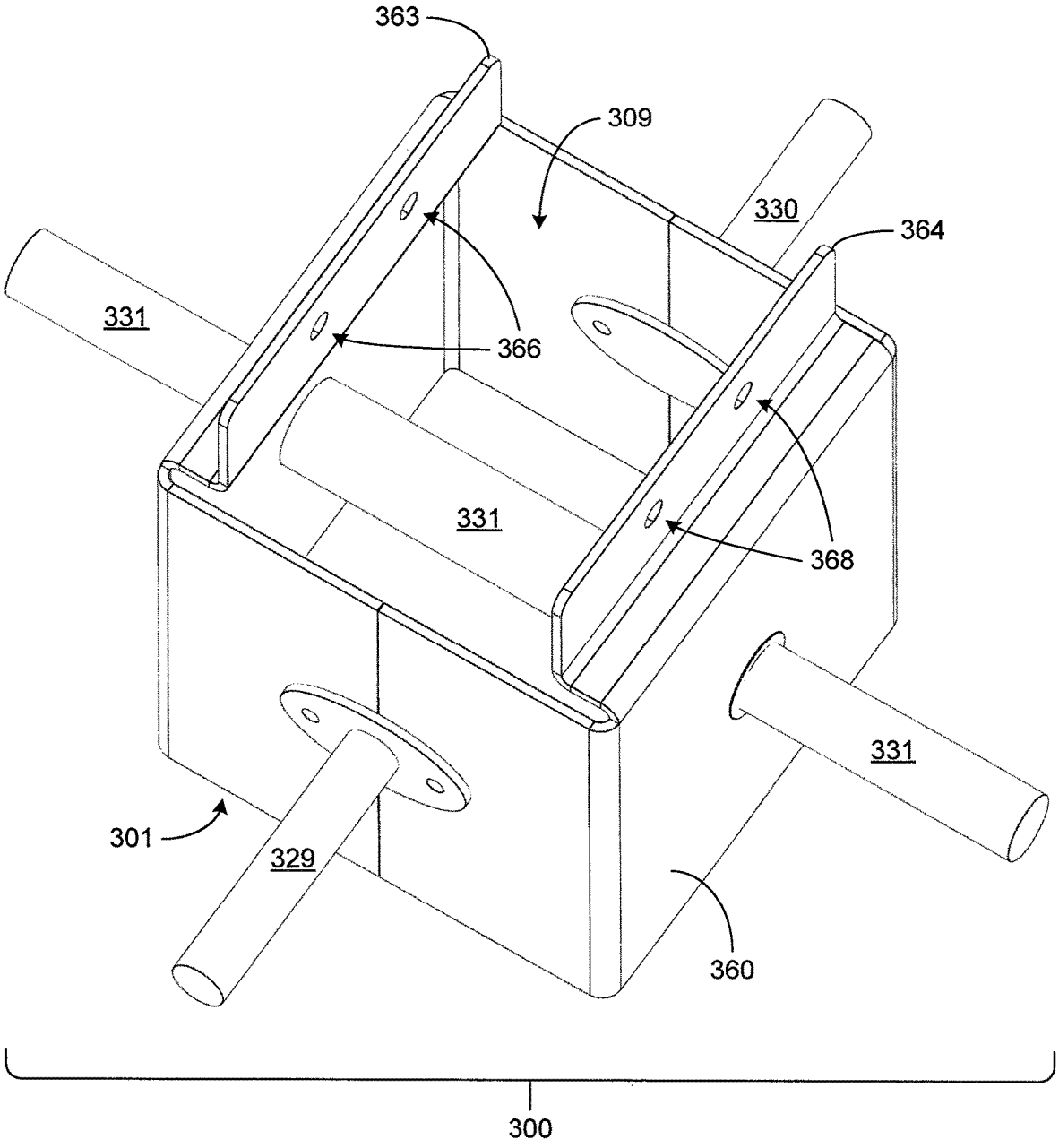
Figure 4C:
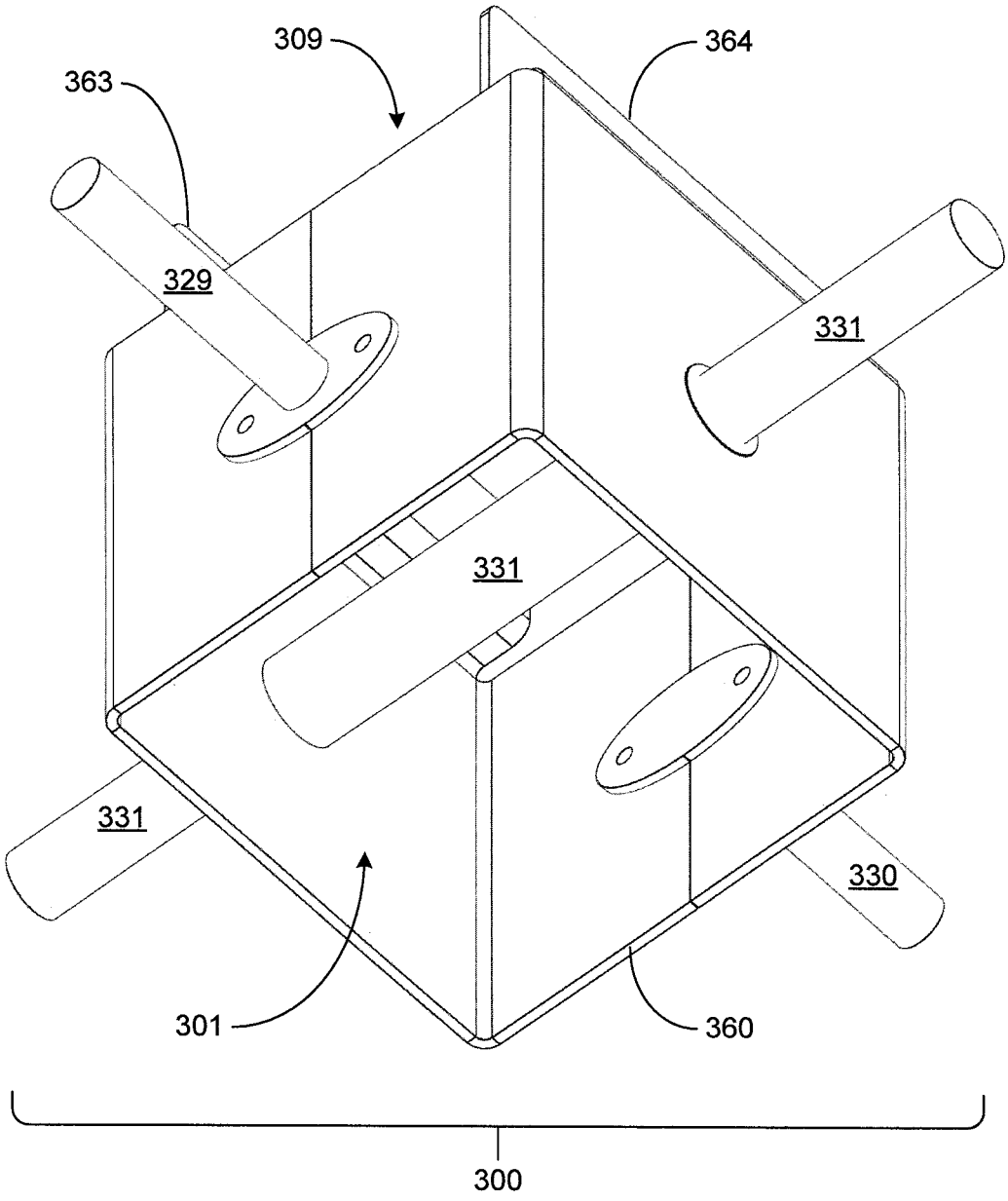
Figure 4D:
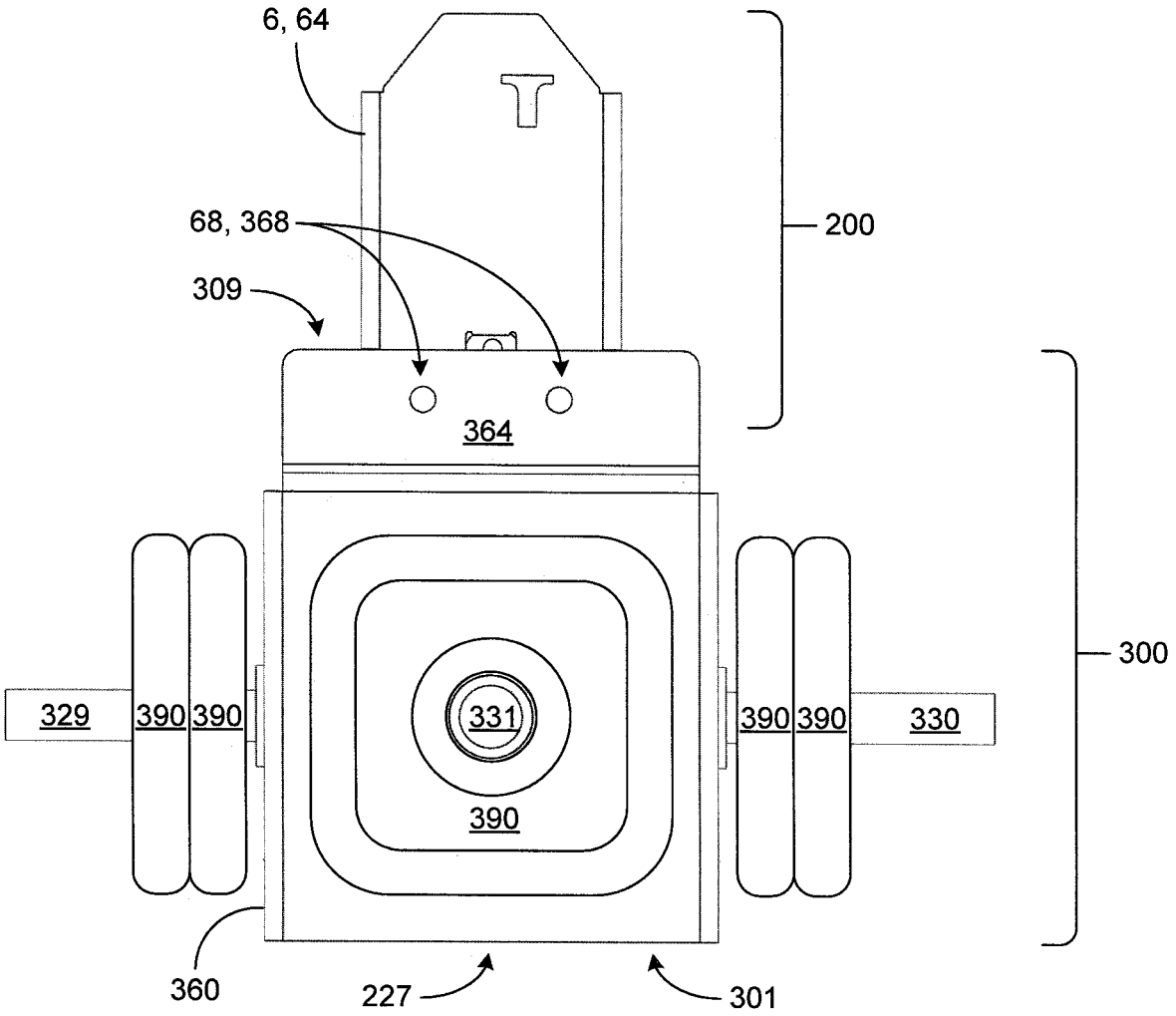
FIG. 4D is a side elevational view of the adapter of FIGS. 4A-C coupled to the variant of improved exercise weight support device of FIGS. 3A-D to adapt free weights of a plate-like configuration for use therewith.

Referring to FIGS. 4A-D, the adapter 300 may have a relatively cube-shaped frame 360 defined by four relatively square-shaped upstanding side walls, but with an open top 309 and an open bottom 301 that cooperate to define a passage that extends vertically through the frame 360. Flanking a pair of opposed edge portions of the open top 309 may be a pair of mounting flanges 363 and 364 through each of which a pair of mounting holes 366 and 368, respectively, may be formed. Each of the pairs of mounting holes 366 and 368 may be shaped, sized and spaced apart in a manner intended to align with a corresponding one of the pairs of mounting holes 66 and 68 carried by lower portions of outer frame 6 of at least the embodiment of the improved exercise weight support device 200 of FIGS. 3A-D at times when those lower portions of the outer frame 6 are inserted into the space between the mounting flanges 363 and 364, as depicted in FIG. 4D.

Continuing to refer to FIGS. 4A-D, bars 329, 330 and 331 extend outwardly from various ones of the four upstanding side walls of the cube-shaped frame 360. As depicted, the cube-shaped frame 360 may be formed from a pair of generally U-shaped pieces of material. Each of the bars 329 and 330 may extend from one of the two seams that are formed where the pair of U-shaped pieces meet and may be bonded to those portions of the cube-shaped frame 360 in any of a variety of ways (e.g., through the depicted flanges). Also, the bar 331 may extend through middle portions of each of the two U-shaped pieces of material, as well as extending cross-wise through the passage defined through the cube-shaped frame 360 between the open top 309 and the open bottom 301.

With the improved exercise weight support device 200 of FIGS. 3A-D and the adapter 300 assembled as depicted in FIG. 4D, use of such an assembly in the performance of weightlifting exercises may entail a weightlifter inserting their hand through the open bottom 301 of the adapter 300 to grasp the portion of the bar 331 therein. As best seen in FIGS. 4B-C, the portion of the bar 331 that extends through the passage may be of a wider diameter than either of the portions of the bar 331 that extend outwardly from two of the upstanding side walls of the cube-shaped frame 360. Such a wider diameter may serve the purpose of providing a more comfortable grip for a weightlifter and/or the purpose of ensuring that the bar 331 remains in position relative to the cube-shaped frame 360.

Though not specifically depicted, with the improved exercise weight support device 200 of FIGS. 3A-D and the adapter 300 so assembled, the trigger handle 19 extends downward through the open top 309, into the passage defined through the cube-shaped frame 360, and into close enough proximity to the portion of the bar 331 therein as to enable a weightlifter to operate the trigger handle 19 with the digits of a hand that is grasping the portion of the bar 331 therein. In this way, operation of the trigger handle 19 within such an assembly is caused to resemble the aforedescribed operation of the trigger handle 19 with the combination of the cradle 5 and the pair of hooks 3 and 4 supporting the bar of one of the free weights 29, 30 or 31. More specifically, with a hand inserted through the open bottom 301, into the passage defined within the cube-shaped frame 360, and grasping the portion of the bar 331, therein, a weightlifter may use digits of that hand to reach and pull the trigger handle 19 downward toward that portion of the bar 331, out of a non-operating position, and into an operating position in which the improved retracting reel mechanism 226 is caused to allow the belt 9 to be freely retracted as the weightlifter raises the combination of the improved exercise weight support device 200, the adapter 300 and the weights 390; and allows the belt 9 to be freely played out as the weightlifter lowers that combination.

Figure 5A:
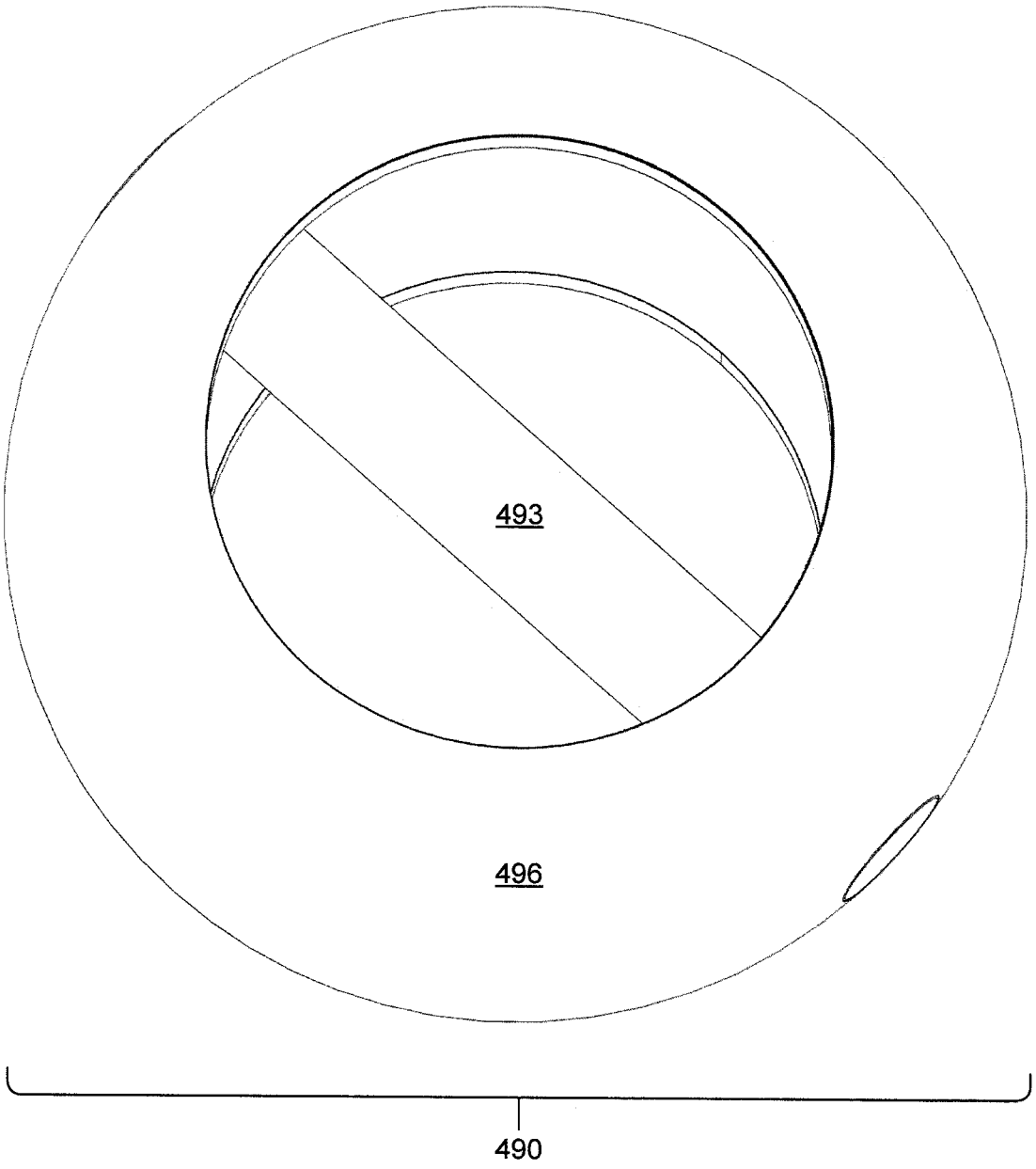
FIG. 5A is a perspective view of free weight of near-spherical configuration.
Figure 5B:
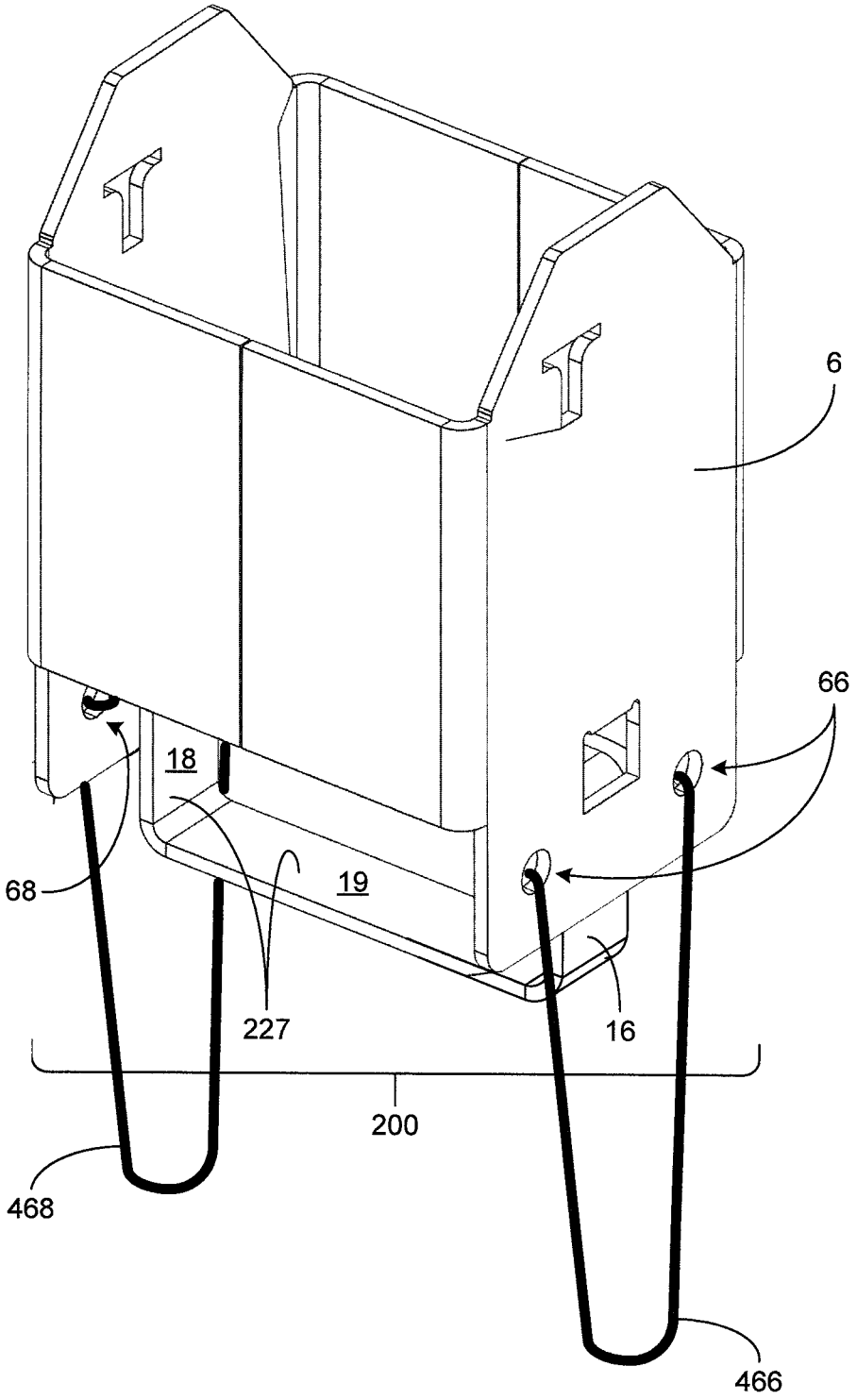
FIGS. 5B and 5C are perspective views of an approach to coupling the variant of improved exercise weight support device of FIGS. 3A-D to the near-spherical free weight of FIG. 5A.
Figure 5C:
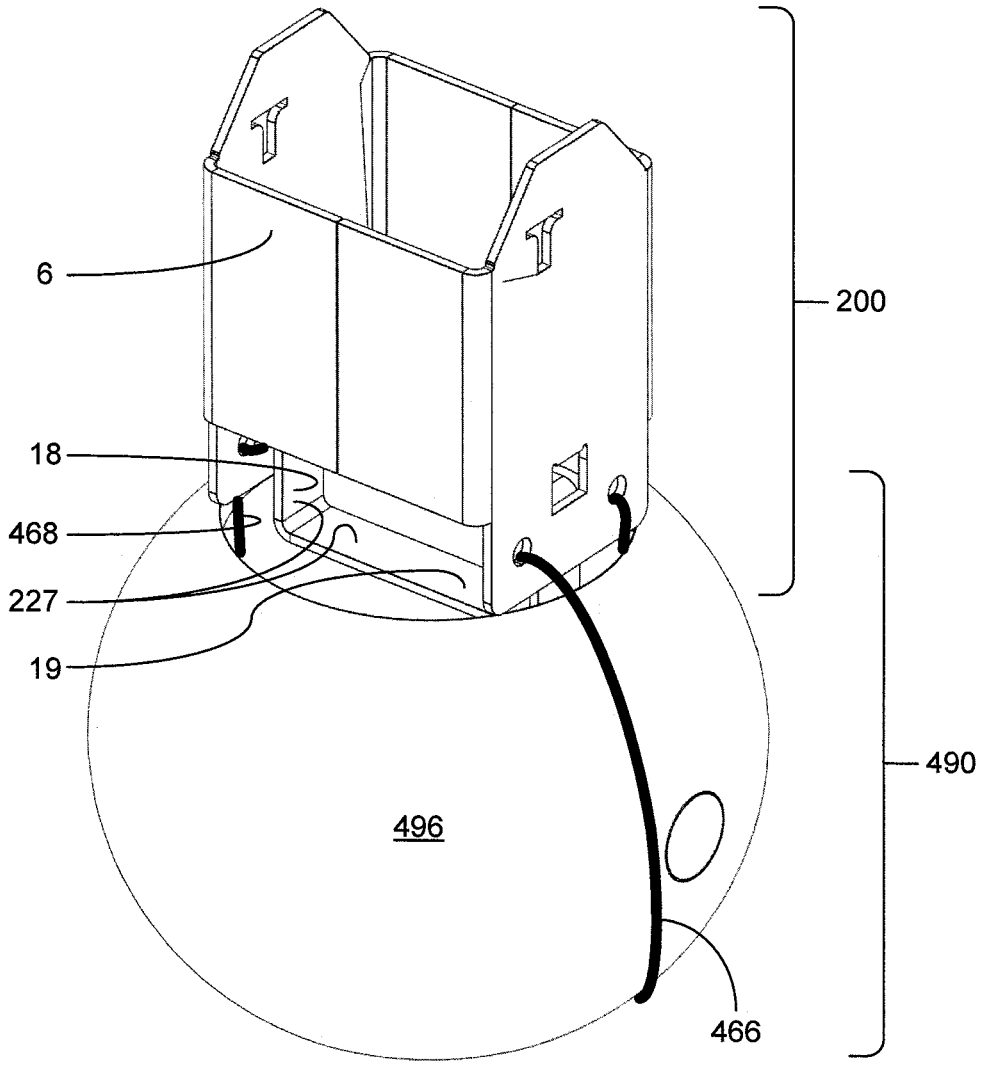

FIGS. 5A through 5C, taken together, depict aspects of an example embodiment of coupling at least the embodiment of the improved exercise weight support device 200 of FIGS. 3A-D to a near-spherical free weight 490. More specifically, the depicted near-spherical free weight 490 may be one of a set of CENTER MASS BELL® free weights offered by Sorinex Exercise Equipment, Inc. of Lexington, South Carolina, USA.

Referring to FIG. 5A, as depicted, such a free weight has a generally spherical outer wall 496 with a passage formed therethrough within which a bar 493 extends cross-wise to provide a grip for use by weightlifters. The reader is invited to refer to U.S. Pat. No. 9,573,014 issued Feb. 21, 2017 to Albert and Richard Sorin of the Sorin family of Sorinex Exercise Equipment, Inc. for a more detailed discussion and more complete depiction of the features of such a free weight.

Referring to FIGS. 5B-C, as specifically depicted, a variant of the embodiment of the improved exercise weight support device 200 of FIGS. 3A-D may be coupled to the free weight 490 using a pair of mounting straps 466 and 468 that may be installed within each of a corresponding pair of the mounting holes 66 and 68. In some embodiments, each of the mounting straps 466 and 468 may be any of a variety of types of cord, wire, fabric strap material, elastomeric tubing of relatively small diameter, etc. Further, each of the mounting straps 466 and 468 may be attached and/or coupled to a corresponding pair of the mounting holes 66 and 68 using any of a variety of attachment components to form a releasable coupling therebetween, including and not limited to, fabric snaps, hooks and eyes, clamps and/or clasps, relatively small carabiners, etc.

As depicted in FIG. 5C, each of the mounting straps 466 and 468 may be partially wrapped around a different portion of the near-spherical outer wall 496 of the free weight 490. However, in other embodiments, each of the mounting straps 466 and 468 may extend entirely into the passage formed through the free weight 490 and may be wrapped around the bar 493 therein. Still other approaches to using the mounting straps 466 and 468 to strap the free weight 490 to the mounting holes 66 and 68, and/or to other portion(s) of the outer frame 6 of at least the embodiment of the improved exercise weight support device 200 of FIGS. 3A-D may be used.

FIGS. 6A through 6F, taken together, depict aspects of an example embodiment of an improved sheet-like bar wrap 500. It should be noted that the bar wrap 500 may be used with the prior art exercise weight support device 100 of Kay et al., and/or with the various free weights 29, 30 and/or 31, as well as with either of the embodiments of the improved exercise weight support device 200 of FIGS. 2A-C and 3A-D and/or with such adapters as the adapter 300.

Figure 6A:
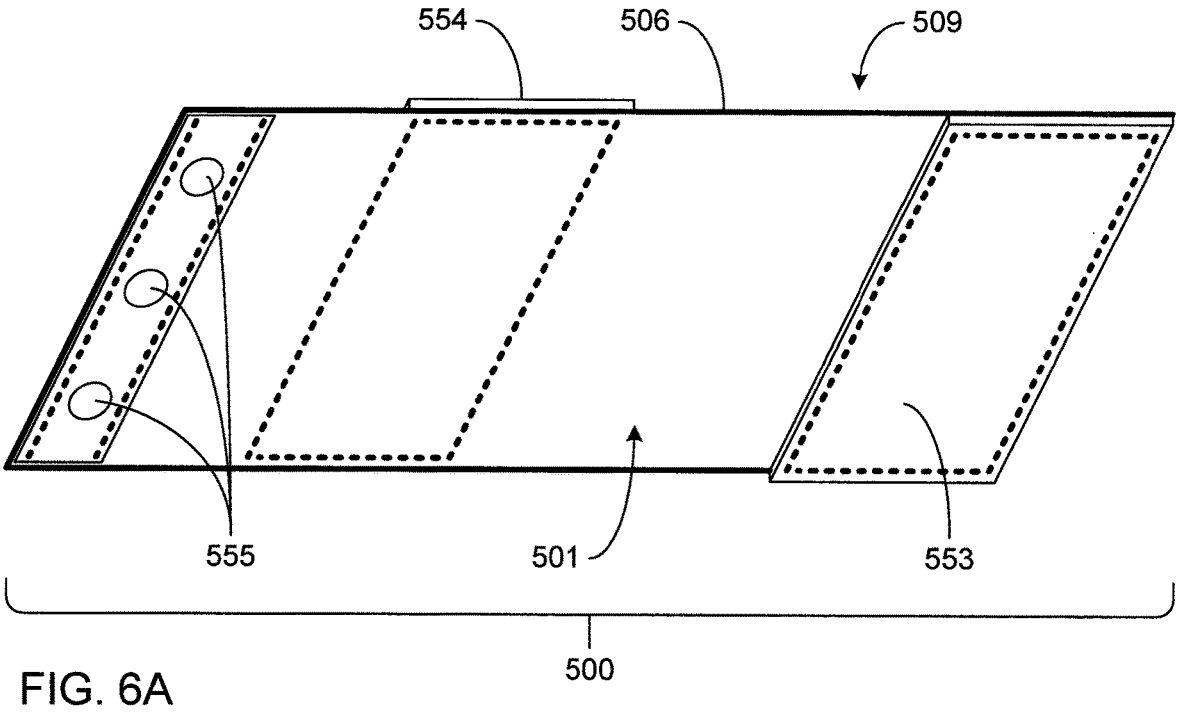
FIGS. 6A and 6B are perspective views of an embodiment of a first improved bar wrap useable with either the prior art exercise weight support device of FIGS. 1A-D or the improved exercise weight support devices of FIGS. 2A-C and 3A-D.
Figure 6B:
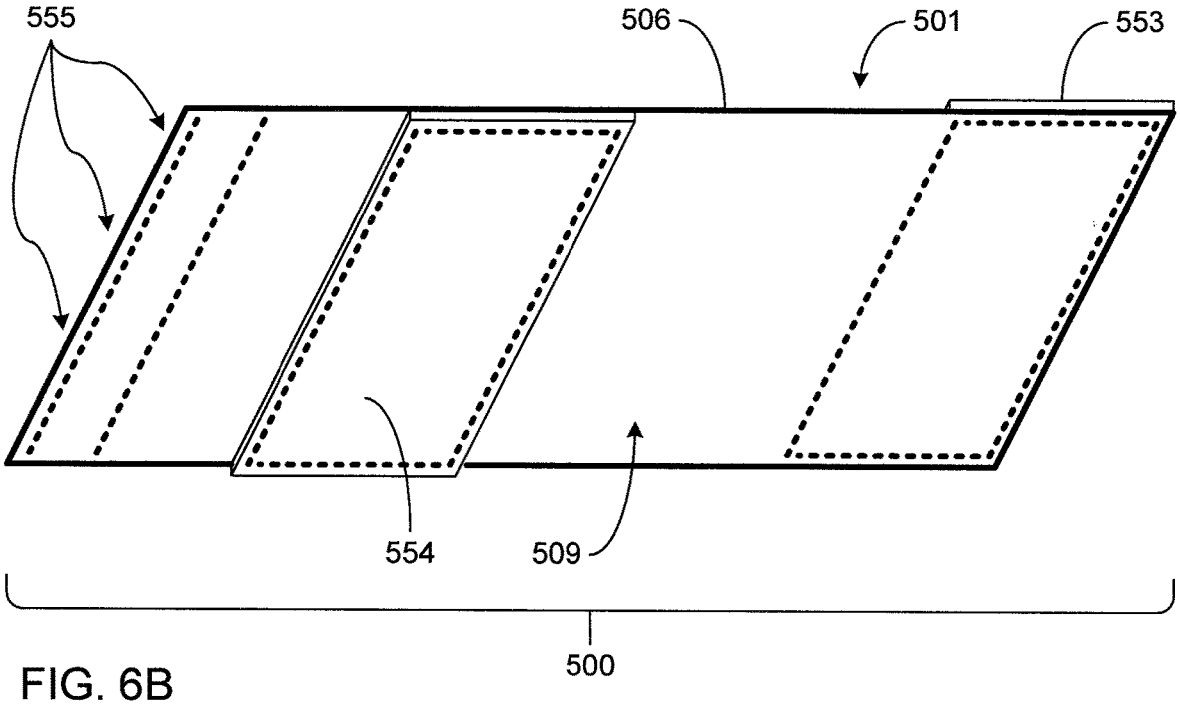
Figure 6C:
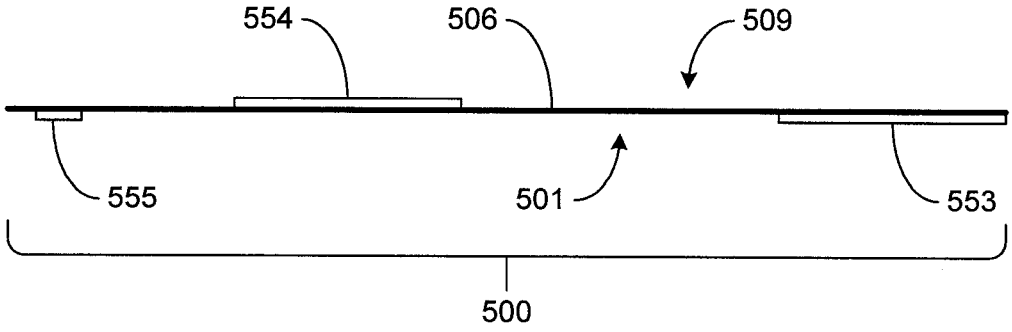
FIGS. 6C, 6D, 6E and 6F are side elevational views showing aspects of using the first improved bar wrap of FIGS. 6A-B.

Referring to FIGS. 6A-C, the bar wrap 500 has a generally rectangular sheet-like shape with an outer surface 509 that is intended to face outwardly when the bar wrap 500 is wrapped around a bar of an adapter (e.g., the bar 331 of the adapter 300) or at least a bar of a free weight (e.g., the bar 493 of the free weight 490), and an inner surface 501 that is intended to face inwardly when the bar wrap 500 is so used. Much of the shape and size of the bar wrap 500 is determined by a flexible sheet substrate 506 that may be made up of any of a variety of fabrics (e.g., ballistic nylon) and/or any of a variety of elastic materials (e.g., rubber).

As depicted, a strip of magnets 555 may be stitched onto the inner surface 501 at one end of the flexible sheet substrate 506. It should be noted that, although a strip of visible individual magnets 555 is depicted, in other embodiments, such individual magnets 555 may be embedded within one end of the flexible sheet substrate 506 so as to not be visible. Alternatively or additionally, in other embodiments, a single-piece strip of flexible magnetic material may be used in place of the depicted strip of individual magnets 555, whether on the inner surface 501 of one end of the flexible sheet substrate 506 or embedded therein. It should also be noted that, instead of stitching, the strip of magnets 555 or of a single-piece strip of flexible magnetic material may be affixed to the inner surface 501 in other ways than by stitching (e.g., via an adhesive, heat welding, insertion within the material of the flexible substrate 506, etc.).

As also depicted, a patch 553 of hook fasteners or of loop fasteners of a matched set of patches 553 and 554 of hook-and-loop fasteners may be stitched onto the inner surface 501 at the end of the flexible sheet substrate 506 that is opposite the end onto which the strip of magnets 555 is depicted as stitched, and the patch 554 of the other of the matched set of patches 553 and 554 of hook-and-loop fasteners may be stitched onto the outer surface 509 at a location between the ends. It should also be noted that, instead of stitching, one or both of the patches 553 and 554 may be affixed to the flexible sheet substrate 506 in other ways than by stitching (e.g., via an adhesive, heat welding, etc.).

Figure 6D:
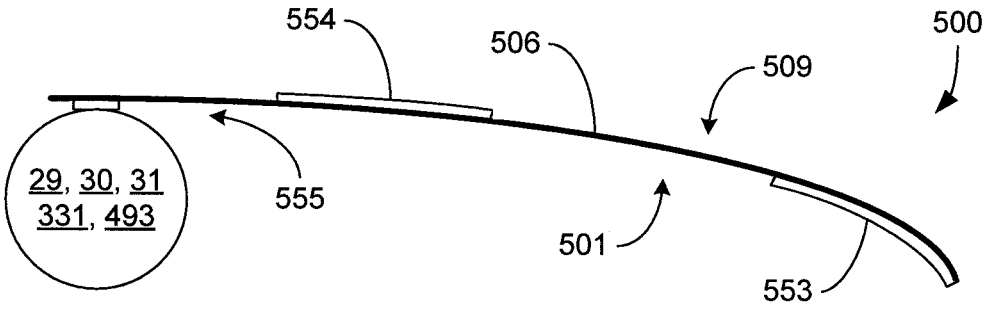
Figure 6E:
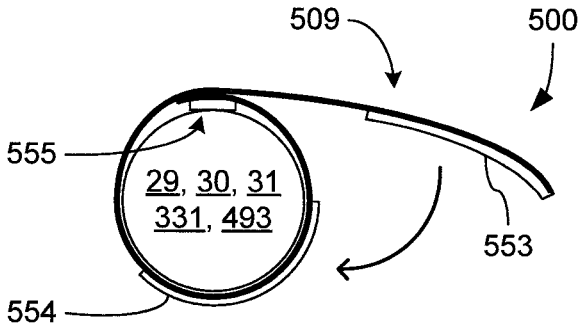

Referring to FIGS. 6D-E, use of the bar wrap 500 to provide a weightlifter with a better grip of the surface of a bar of an adapter or of a free weight may entail first positioning the end of the bar wrap 500 that carries the magnets 555 (or other form of magnetic material) in relatively close proximity to the bar to enable magnetism to pull and maintain that end of the bar wrap 500 in contact with the bar. The bar wrap 500 may then be wrapped around the bar and the bar wrap 500, itself, as shown, and then the patch 553 may be brought into contact with the patch 554 such that the matched set of hook-and-loop fasteners are caused to become engaged to thereby hold the bar wrap 500 in a wrapped-around configuration surrounding the circumference of a portion of the bar.

Figure 6F:
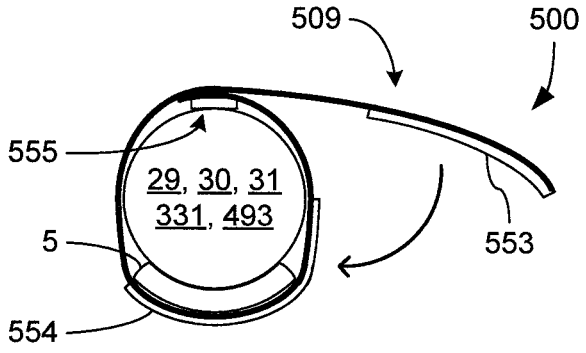

Referring to FIG. 6F, the bar wrap 500 may, alternatively, be similarly wrapped around a combination of a bar of a free weight and the cradle 5 of either the prior art exercise weight support device 100 of Kay et al., or either of the embodiments of the improved exercise weight support device 200 of FIGS. 2A-C and 3A-D. The manner in which the bar wrap 500 may be wrapped around such a combination may be substantially similar to what was just described above for wrapping the bar wrap 500 around solely the bar of an adapter or of a free weight, although the flexible sheet substrate 506 may be made somewhat longer to better fit around such a combination.

FIGS. 7A through 7G, taken together, depict aspects of an example embodiment of an improved sheet-like bar wrap 600. Like the bar wrap 500, it should be noted that the bar wrap 600 may also be used with the prior art exercise weight support device 100 of Kay et al., and/or with the various free weights 29, 30 and/or 31, as well as with either of the embodiments of the improved exercise weight support device 200 of FIGS. 2A-C and 3A-D and/or such adapters as the adapter 300.

Figure 7A:
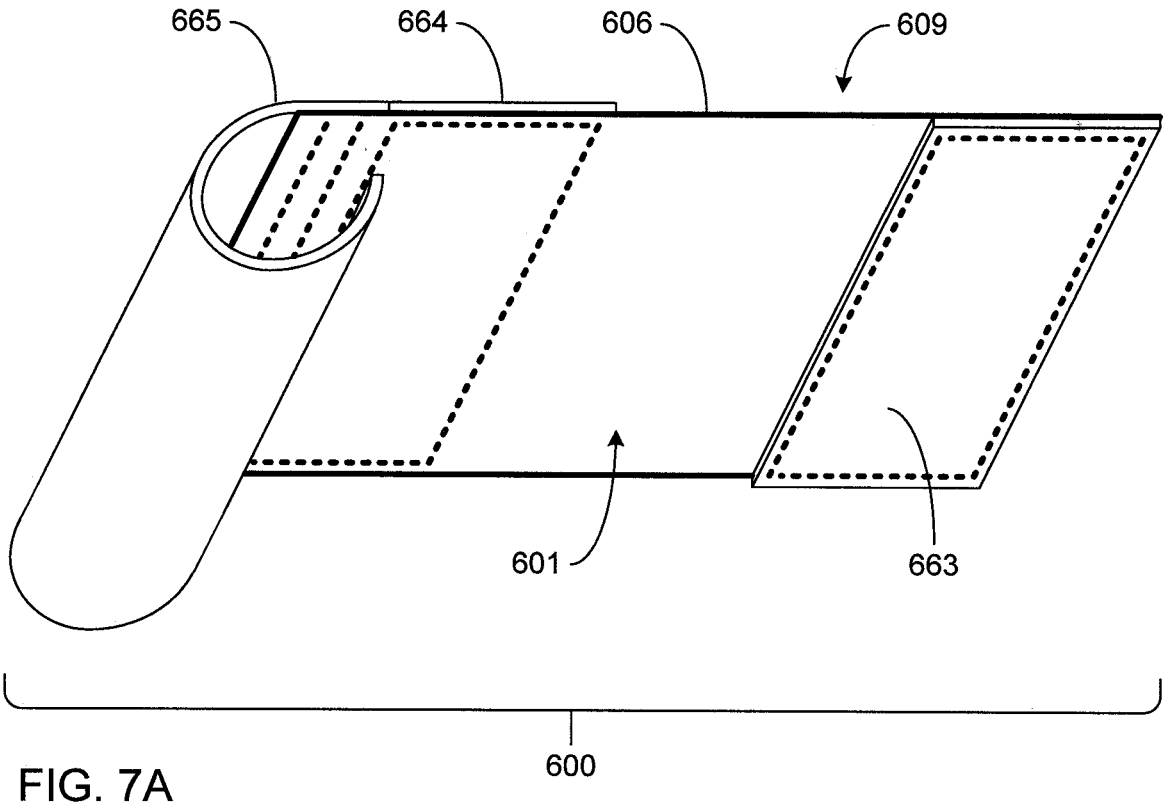
FIGS. 7A and 7B are perspective views of an embodiment of a second improved bar wrap useable with either the prior art exercise weight support device of FIGS. 1A-D or the improved exercise weight support devices of FIGS. 2A-C and 3A-D.
Figure 7B:
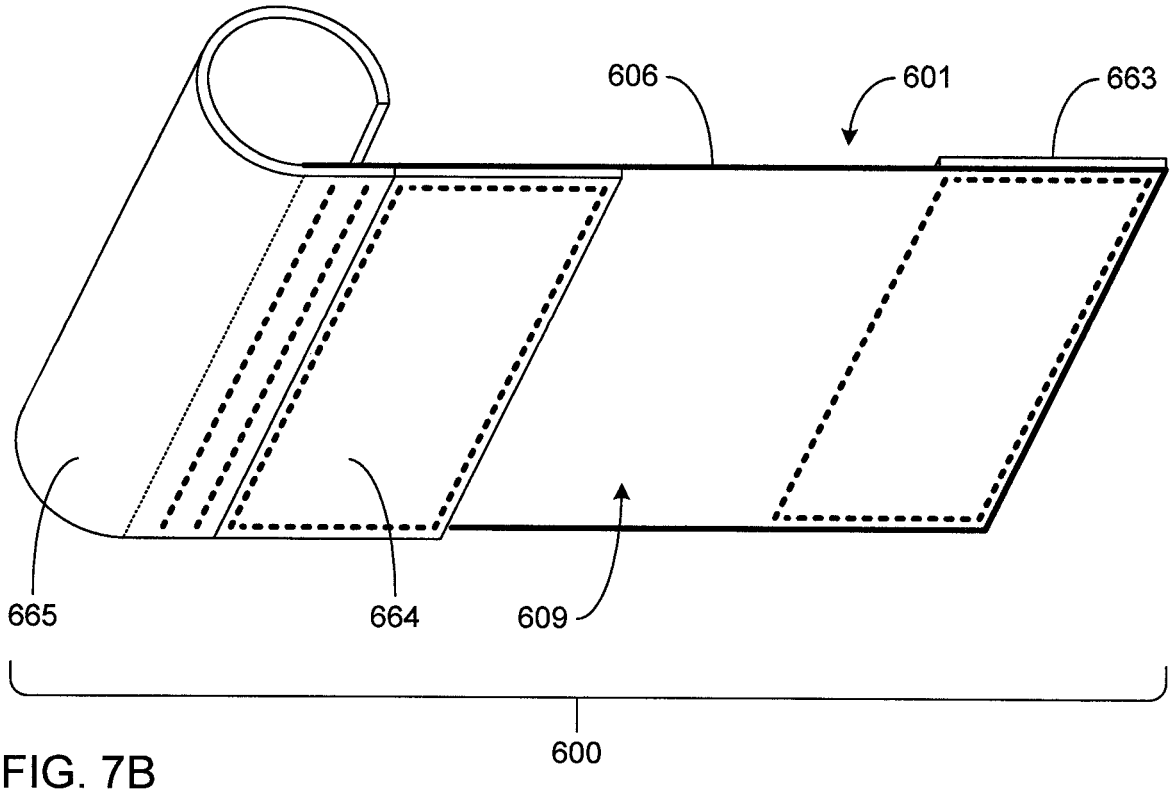
Figure 7C:
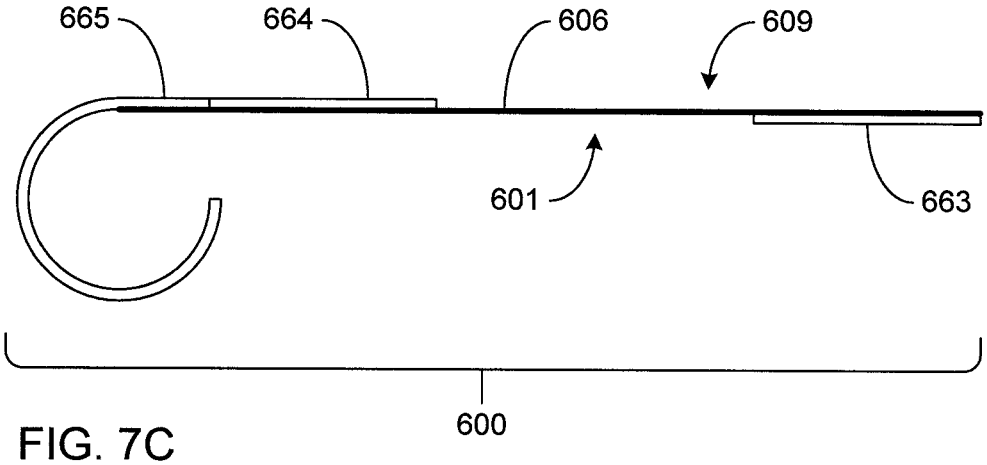
FIGS. 7C, 7D, 7E, 7F and 7G are side elevational views showing aspects of using the second improved bar wrap of FIGS. 7A-B.

Referring to FIGS. 7A-C, like the bar wrap 500, the bar wrap 600 also has a generally rectangular sheet-like shape with an outer surface 609 that is intended to face outwardly when the bar wrap 600 is wrapped around a bar of an adapter (e.g., the bar 331 of the adapter 300) or at least the bar of a free weight (e.g., the bar 493 of the free weight 490), and an inner surface 601 that is intended to face inwardly when the bar wrap 600 is so used. Much of the shape and size of the bar wrap 600 is determined by a flexible sheet substrate 606 that may be made up of any of a variety of fabrics and/or any of a variety of elastic materials.

As depicted, one end of the flexible sheet substrate 606 may not extend all the way to one end of the bar wrap 600, thereby allowing both sides of a patch 665 of flexible gripping material (e.g., a rubber or flexible elastomer, etc.) to be exposed, except where a portion of the side of the patch 665 that forms part of the inner side 601 of the bar wrap 600 is stitched onto an end portion of the flexible sheet substrate 606 that would otherwise form part of the outer surface 609 of the bar wrap 600. In this way, the patch 665 serves to provide part of the inner surface 601 and part of the outer surface 609 of the bar wrap 600 at that end thereof. It should also be noted that, instead of stitching, the patch 665 of flexible gripping material may be affixed to that portion of the flexible sheet substrate 606 in other ways than by stitching (e.g., via an adhesive, heat welding, etc.).

As also depicted, a patch 663 of hook fasteners or of loop fasteners of a matched set of patches 663 and 664 of hook-and-loop fasteners may be stitched onto the inner surface 601 at the end of the flexible sheet substrate 606 that is opposite the end onto which the patch 665 of flexible gripping material is depicted as stitched, and the patch 664 of the other of the matched set of patches 663 and 664 of hook-and-loop fasteners may be stitched onto the outer surface 609 at a location between the ends. It should also be noted that, instead of stitching, each of the patches 663 and 664 may be affixed to the flexible sheet substrate 606 in other ways than by stitching (e.g., via an adhesive, heat welding, etc.).

As further depicted, in at least some embodiments, the patch 665 of flexible gripping material may be formed by extrusion and/or in any of a variety of other ways that may impart a curving configuration thereto. Such a curved configuration of the patch 665 may define a partially enclosed cylindrical volume that may become filled with a portion of a bar of a free weight or of an adapter when the bar wrap 600 is used. Further a slot-like opening may be defined by the depicted curved configuration such that such a portion of such a bar may be slipped into the partially enclosed cylindrical volume therethrough with the flexibility of the patch 665 imparting a spring-like characteristic thereto such that the patch 665 could be said to "snap" onto such a portion of such a bar.

As part of enabling such a "snap-on" behavior, the radius of such a curve imparted to the patch 665 may be selected based on the expected radii of the bars of various forms of free weights, and/or the radii of the bars of various adapters for use with at least the improved exercise weight support device 200 of FIGS. 3A-D. More specifically, the radius of the partially enclosed cylindrical volume defined by the curved configuration of the patch 665 may be selected to be somewhat smaller than the expected radii of whatever bars that the bar wrap 600 is expected to be used with. In addition to aiding in causing such a "snap-on" behavior, such a smaller radius may also assist in pressing the portion of the inner surface 601 that is defined by the patch 665 into more forceful contact with the exterior surface of the portion of the bar around which the bar wrap 600 is wrapped.

Figure 7D:
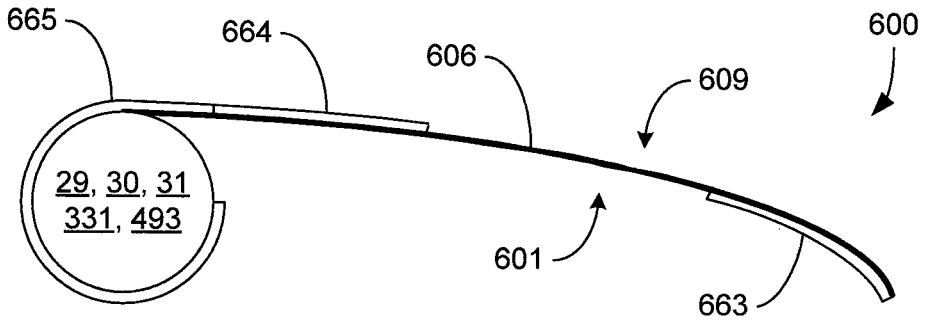
Figure 7E:
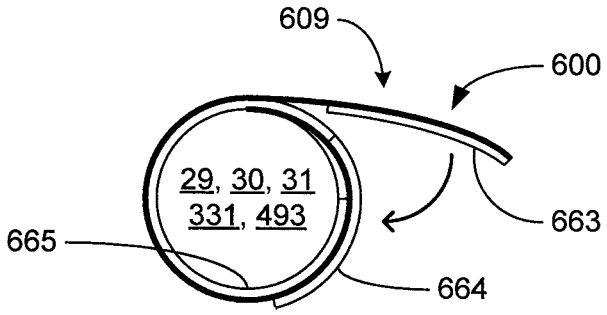

Referring to FIGS. 7D-E, use of the bar wrap 600 to provide a weightlifter with a better grip of the surface of a bar of an adapter or of a free weight may entail slipping the bar of a free weight or an adapter into the partially enclosed cylindrical volume defined by the curved configuration of the patch 665 such that the patch 665 is caused to "snap" onto the bar, as has been described above. More of the bar wrap 600 may then be wrapped onto the bar wrap 600, itself, and around the bar, as shown, and then the patch 653 may be brought into contact with the patch 654 such that the matched set of hook-and-loop fasteners are caused to become engaged to thereby hold the bar wrap 600 in a wrapped-around configuration surrounding the circumference of a portion of the bar.

Figure 7F:
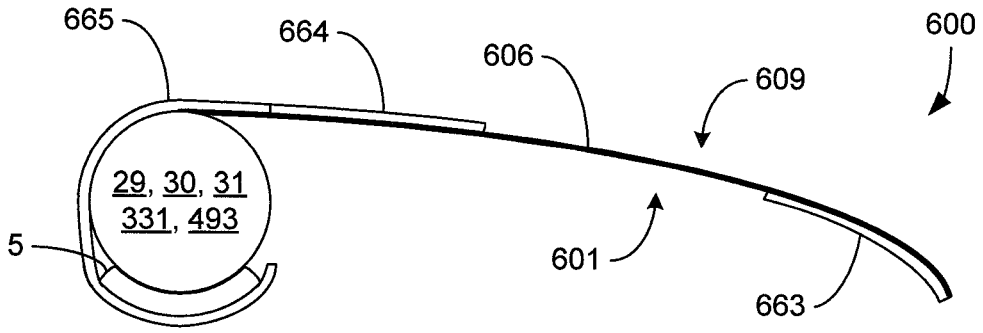
Figure 7G:
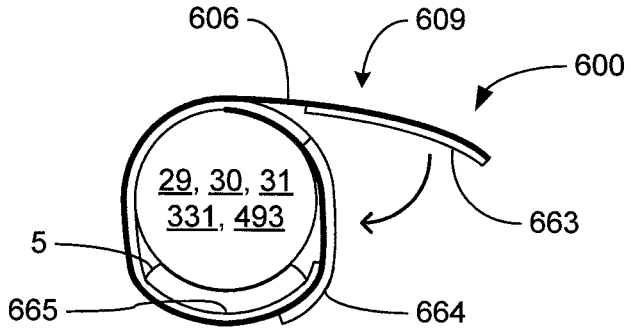

Referring to FIGS. 7F-G, the bar wrap 600 may, alternatively, be similarly wrapped around a combination of a bar of a free weight and the cradle 5 of either the prior art exercise weight support device 100 of Kay et al., or either of the embodiments of the improved exercise weight support device 200 of FIGS. 2A-C and 3A-D. The manner in which the bar wrap 600 may be wrapped around such a combination may be substantially similar to what was just described above for wrapping the bar wrap 600 around solely the bar of an adapter or of a free weight, although the flexible sheet substrate 606 may be made somewhat longer to better fit around such a combination.

FIGS. 8A through 8F, taken together, depict aspects of an example embodiment of an improved sheet-like bar wrap 700. Like the bar wraps 500 and 600, it should be noted that the bar wrap 700 may also be used with the prior art exercise weight support device 100 of Kay et al., and/or with the various free weights 29, 30 and/or 31, as well as with either of the embodiments of the improved exercise weight support device 200 of FIGS. 2A-C and 3A-D and/or such adapters as the adapter 300.

Figure 8A:
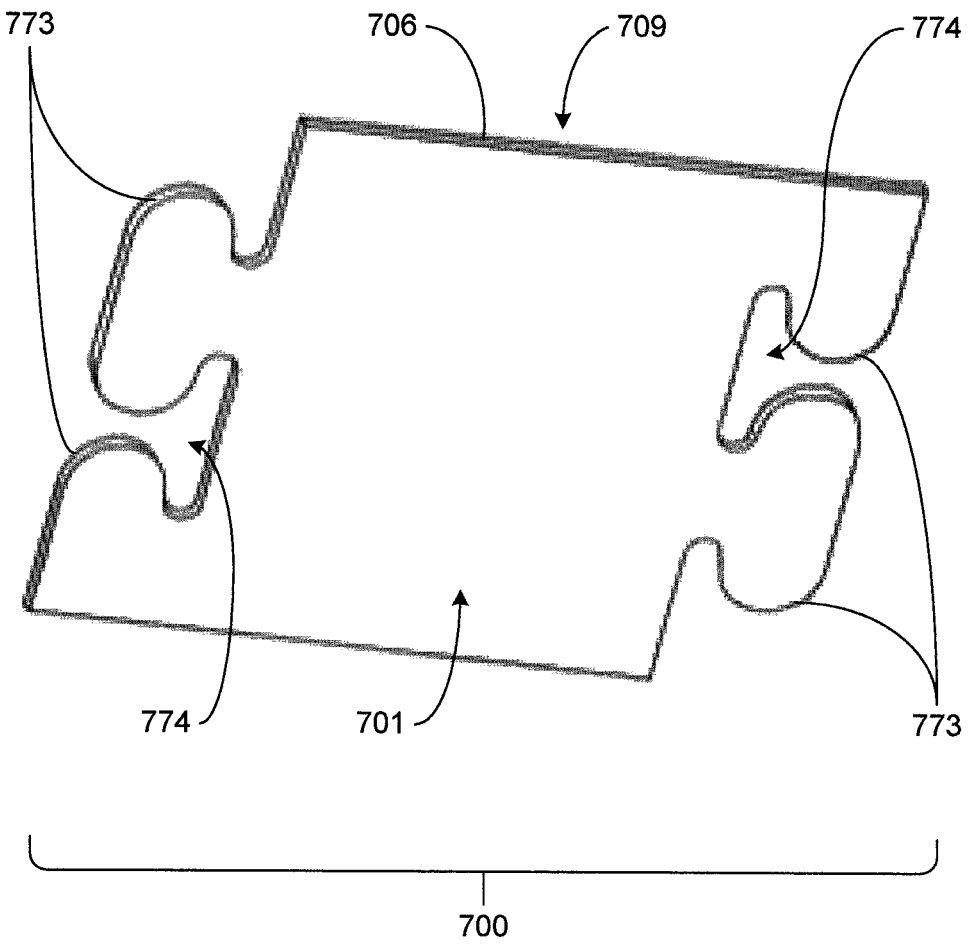
FIGS. 8A and 8B are perspective views of an embodiment of a third improved bar wrap useable with either the prior art exercise weight support device of FIGS. 1A-D or the improved exercise weight support devices of FIGS. 2A-C and 3A-D.

Referring to FIG. 8A, like the bar wraps 500 and 600, the bar wrap 700 also has a generally rectangular sheet-like shape with an outer surface 709 that is intended to face outwardly when the bar wrap 700 is wrapped around a bar of an adapter (e.g., the bar 331 of the adapter 300) and/or at least the bar of a free weight (e.g., the bar 493 of the free weight 490), and an inner surface 701 that is intended to face inwardly when the bar wrap 700 is so used. However, unlike the bar wraps 500 and 600, there may be little difference between the inner surface 701 and the outer surface 709 of the bar wrap 700 such that these two surfaces may be regarded as interchangeable such that the bar wrap 700 may be wrap around a bar with either surface serving as the inner surface 701 or the outer surface 709. Much of the shape and size of the bar wrap 700 is determined by a flexible sheet substrate 706 that may be made up of any of a variety of fabrics and/or any of a variety of elastic materials.

As depicted, multiple interlocking tabs 773 may be formed on opposite ends of the flexible sheet substrate 706, with cutaway regions 774 separating adjacent ones of the interlocking tabs 773. The interlocking tabs 773 and cutaway regions 774 may be of identical configuration on each of the opposing ends. As depicted, each of tabs 773 may be shaped to define a relatively broad portion that is separated from the rest of the flexible sheet substrate 706 by a relative narrow neck portion. Such a shape of each of the tabs 773 may define each of the cutaway regions 774 as opening through the edge of one of the opposing ends of the flexible sheet substrate 706 with a relatively narrow open region between the relatively broad regions of two adjacent tabs 773, with the relatively narrow open region then widening into a relatively broad open region between the relatively narrow neck regions of the same two adjacent tabs 773.

Figure 8B:
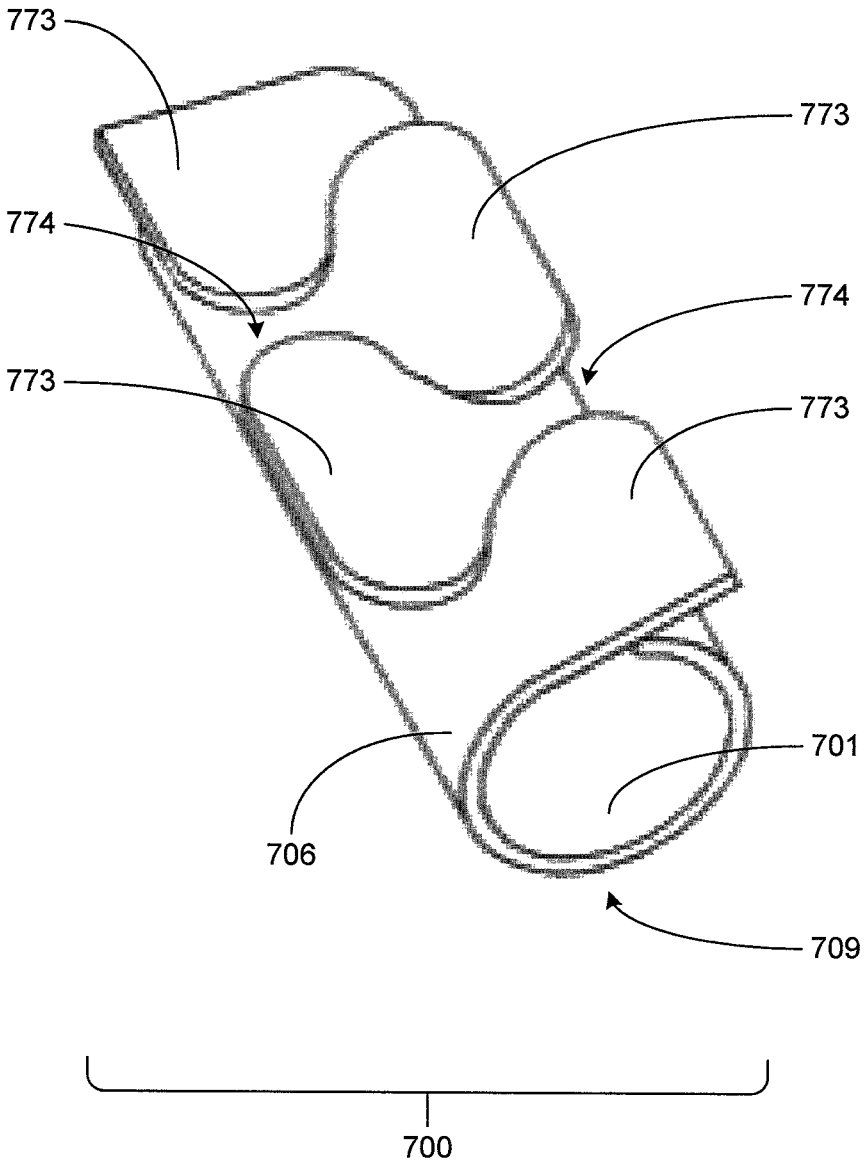

Referring to FIG. 8B, this shaping of the tabs 773, and accordingly, of the cutaway regions 774, serves to enable the tabs 773 of each of the opposing ends of the flexible sheet substrate 706 to interact with each other in a manner akin to the teeth of a zipper. Thus, the two opposing ends of the flexible sheet substrate 706 are able be brought together and coupled to each other by causing the 773 to interlock or "interdigitate" as would the teeth of a zipper.

Figure 8C:
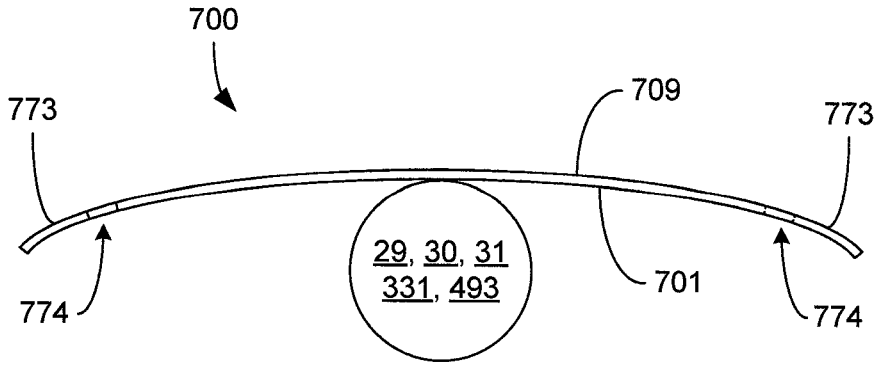
FIGS. 8C, 8D, 8E and 8F are side elevational views showing aspects of using the third improved bar wrap of FIGS. 8A-B.
Figure 8D:
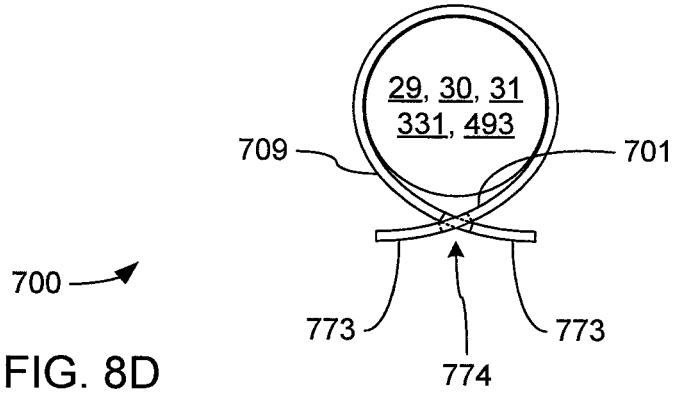

Referring to FIGS. 8C-D, use of the bar wrap 700 to provide a weightlifter with a better grip of the surface of a bar of an adapter or of a free weight may entail first positioning the inner surface 701 of the bar wrap 700 against the bar and then wrapping both of the opposing ends that carry the tabs 773 around the bar, bringing the opposing ends together. The relatively narrow neck regions of the tabs 773 carried by one of the opposing ends of the bar wrap 700 may then be inserted through the relatively narrow open regions of corresponding ones of the cutaway regions 774 of the other of the opposing ends to thereby cause the interlocking or "interdigitating" of the tabs 773 of both of the opposing ends of the bar wrap 700.

Figure 8E:
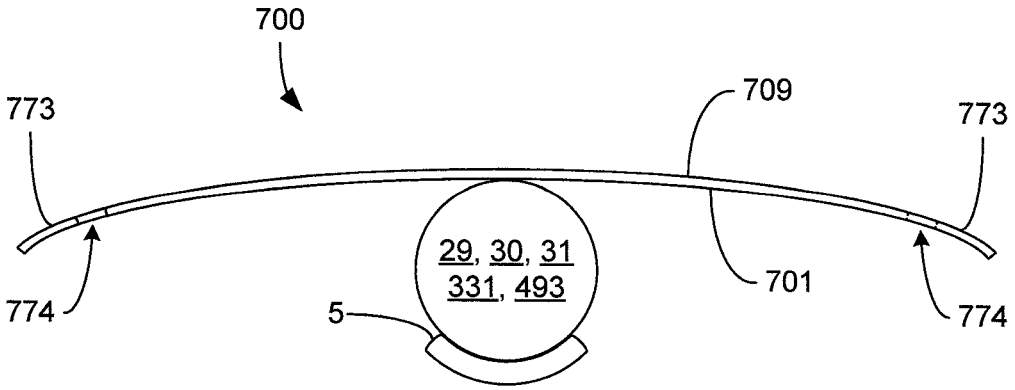
Figure 8F:
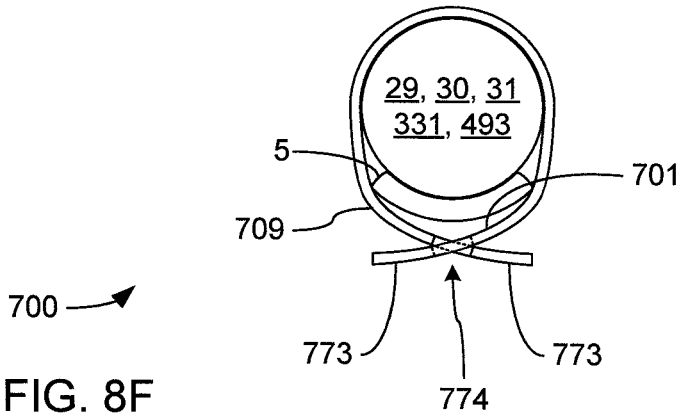

Referring to FIGS. 8E-F, the bar wrap 700 may, alternatively, be similarly wrapped around a combination of a bar of a free weight and the cradle 5 of either the prior art exercise weight support device 100 of Kay et al., or either of the embodiments of the improved exercise weight support device 200 OF FIGS. 2A-C and 3A-D. The manner in which the bar wrap 700 may be wrapped around such a combination may be substantially similar to what was just described above for wrapping the bar wrap 700 around solely the bar of an adapter or of a free weight, although the flexible sheet substrate 706 may be made somewhat longer to better fit around such a combination.

FIGS. 9A through 9D, taken together, depict aspects of an example embodiment of an improved sheet-like bar wrap 800. Like the bar wraps 500, 600 and 700, it should be noted that the bar wrap 800 may also be used with the prior art exercise weight support device 100 of Kay et al., and/or with the various free weights 29, 30 and/or 31, as well as with either of the embodiments of the improved exercise weight support device 200 of FIGS. 2A-C and 3A-D and/or such adapters as the adapter 300.

Figure 9A:
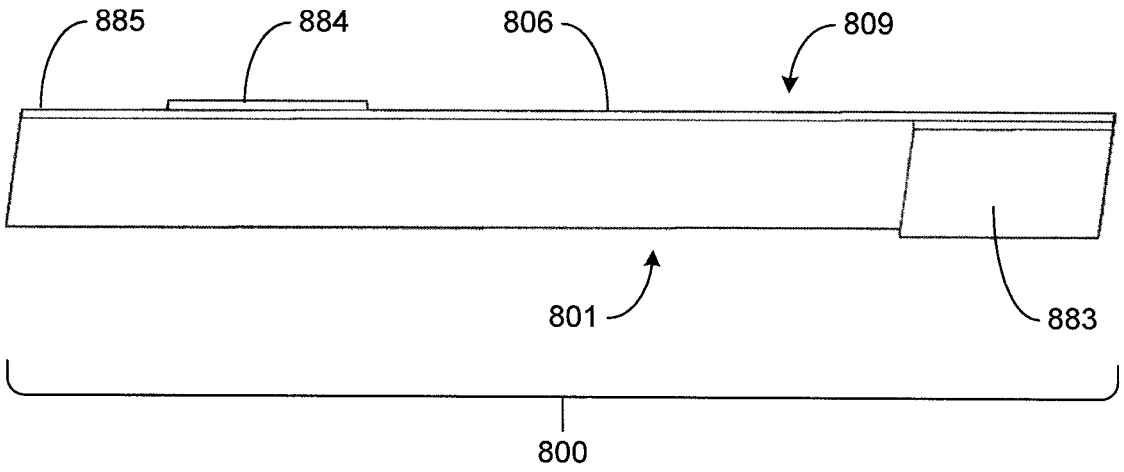
FIGS. 9A and 9B are perspective views of an embodiment of a fourth improved bar wrap useable with either the prior art exercise weight support device of FIGS. 1A-F or the improved exercise weight support devices of FIGS. 2A-C and 3A-D.
Figure 9B:
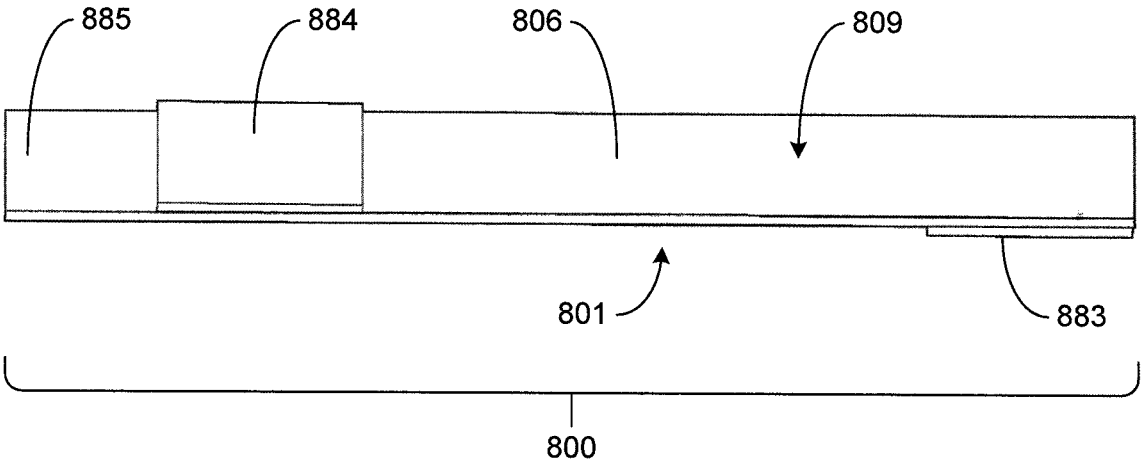

Referring to FIGS. 9A-B, the bar wrap 800 has a generally rectangular sheet-like shape with an outer surface 809 that is intended to face outwardly when the bar wrap 800 is wrapped around a combination of a cradle 5 and a bar of an adapter (e.g., the bar 331 of the adapter 300), or a combination of a cradle 5 and a bar of a free weight (e.g., the bar 493 of the free weight 490), and an inner surface 801 that is intended to face inwardly when the bar wrap 800 is so used. Much of the shape and size of the bar wrap 800 is determined by a flexible sheet substrate 806 that may be made up of any of a variety of fabrics (e.g., ballistic nylon) and/or any of a variety of elastic materials (e.g., rubber).

As depicted, a patch 883 of hook fasteners or of loop fasteners of a matched set of patches 883 and 884 of hook-and-loop fasteners may be stitched onto the inner surface 801 at one end of the flexible sheet substrate 806, and the patch 884 of the other of the matched set of patches 883 and 884 of hook-and-loop fasteners may be stitched onto the outer surface 809 at a location between both ends of the flexible sheet substrate 806. As a result, the end of the flexible sheet substrate 806 that is opposite the end onto which patch 883 may simply be a bare portion 885 of the flexible sheet substrate 806. It should also be noted that, instead of stitching, one or both of the patches 883 and 884 may be affixed to the flexible sheet substrate 806 in other ways than by stitching (e.g., via an adhesive, heat welding, etc.).

Figure 9C:
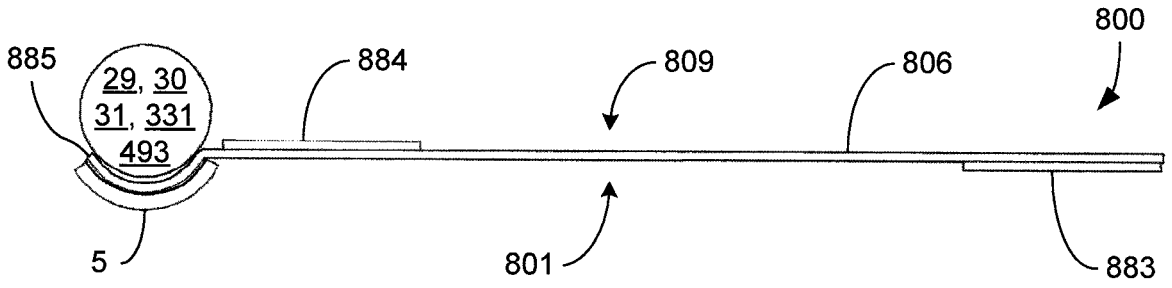
FIGS. 9C and 9D are side elevational views showing aspects of using the fourth improved bar wrap of FIGS. 9A-B.
Figure 9D:
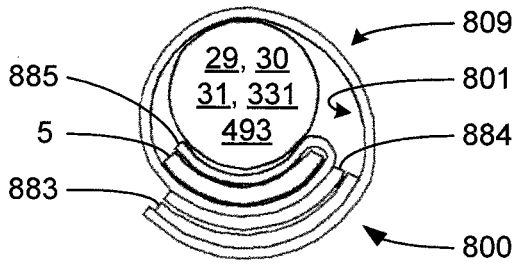

Referring to FIGS. 9C-D, use of the bar wrap 800 to provide a weightlifter with a better grip of the surface of a combination of a bar of a free weight and a cradle 5 may entail first positioning the bare portion 885 that defines one end of the bar wrap 800 between the bar of the free weight and the cradle 5 such that the bare portion 885 becomes pinched therebetween. The bar wrap 800 may then be wrapped around the combination of the bar and the cradle 5, as well as around itself, as shown, and then the patch 883 may be brought into contact with the patch 884 such that the matched set of hook-and-loop fasteners are caused to become engaged to thereby hold the bar wrap 800 in a wrapped-around configuration surrounding the circumference of the combination of the bar and the cradle 5.

The invention claimed is:

1. An exercise weight support device comprising:

a spool to which a lower end of a belt is connected to suspend the exercise weight support device from above by the belt;

an inner frame to which the spool is rotatably mounted at a fixed location relative to the inner frame, the spool to enable more or less of the lower end of the belt to be wound around the spool to enable the exercise weight support device to be suspended by the belt at a higher or lower vertical position;

a ratchet wheel drivingly coupled to the spool to enable control of the rotation of the spool in winding more or less of the lower end of the belt around the spool;

an outer frame within which the inner frame is disposed and to which the inner frame is slidably connected to enable the inner frame and the outer frame to move along a vertical path of travel relative to each other when the exercise weight support device is suspended by the belt, the outer frame comprising at least one of a cradle and a pair of hooks to support a bar of a free weight when the exercise weight support device is suspended by the belt;

a ratchet pawl coupled to the outer frame at a fixed location relative to the outer frame; and a trigger handle connected to the inner frame and manually operable to move the inner frame relative to the outer frame between a non-operating position of the trigger handle in which the ratchet pawl and teeth of the ratchet wheel are caused to engage to restrict the rotation of the spool, and an operating position of the trigger handle in which the ratchet pawl and the teeth of the ratchet wheel are caused to not engage to allow the spool to rotate to cause more or less of the lower end of the belt to be wound around the spool to enable the vertical position at which the exercise weight support device is suspended to be changed.

2. The exercise weight support device of claim 1, wherein the trigger handle is connected to the inner frame with a handle portion that is configured to enable a position of the trigger handle relative to the inner frame to be adjusted to accordingly enable the operating position and the non-operating position of the trigger handle relative to the outer frame to be adjusted.

3. The exercise weight support device of claim 2, wherein the ability to adjust the position of the trigger handle relative to the inner frame enables the non-operating position of the trigger handle to be adjusted to accommodate differing diameters of the bar of the free weight so that the trigger handle is at a distance from the bar that is close enough to allow tips of digits of a hand grasping the bar of the free weight to reach the trigger handle and pull the trigger handle closer toward the bar of the free weight and into the operating position of the trigger handle.

4. The exercise weight support device of claim 1, further comprising a torsion spring drivingly coupled to the spool to bias the spool toward rotating to wind more of the lower end of the belt onto the spool to cause the spool to tend to take up slack in the belt when the vertical position exercise weight support device is raised while the exercise weight support device is suspended by the belt.

5. The exercise weight support device of claim 1, further comprising at least one spring to bias the inner frame along the vertical path of travel toward a position that causes the ratchet pawl and the teeth of the ratchet wheel to engage.

6. The exercise weight support device of claim 1, wherein when the bar of the free weight is supported by the at least one of the cradle and the pair of hooks, the non-operating position of the trigger handle is at a distance from the bar that is close enough to allow tips of digits of a hand grasping the bar to reach the trigger handle and pull the trigger handle closer toward the bar and into the operating position of the trigger handle.

7. The exercise weight support device of claim 1, further comprising:

an additional handle mounted to an exterior portion of the outer frame; and an additional trigger control that is also connected to the inner frame and is manually operable between an non-operating position of the additional trigger control that is close to the additional handle and an operating position of the additional trigger control that is closer still to the additional handle to move the inner frame relative to the outer frame to also cause selective engagement of the ratchet pawl and the teeth of the ratchet wheel in lieu of manual operation of the trigger handle.

8. The exercise weight support device of claim 1, wherein an aperture is formed through an upper portion of the outer frame to allow passage of the lower end of the belt therethrough to be wound around the spool.

9. An exercise weight support device comprising:

a spool to which a lower end of a belt is connected to suspend the exercise weight support device from above by the belt, wherein the spool is rotatable about an axis to enable more or less of the lower end of the belt to be wound around the spool to enable the exercise weight support device to be suspended by the belt at a higher or lower vertical position;

a ratchet wheel drivingly coupled to the spool to enable control of the rotation of the spool in winding more or less of the lower end of the belt around the spool;

an outer frame that comprises at least one of a cradle and a pair of hooks to support a bar of a free weight when the exercise weight support device is suspended by the belt;

a ratchet pawl coupled to the outer frame at a fixed location relative to the outer frame; and a trigger handle connected to the spool and manually operable to move the spool relative to the ratchet pawl between a non-operating position of the trigger handle in which the ratchet pawl and teeth of the ratchet wheel are caused to engage to restrict the rotation of the spool, and an operating position of the trigger handle in which the ratchet pawl and the teeth of the ratchet wheel are caused to not engage to allow the spool to rotate to cause more or less of the lower end of the belt to be wound around the spool to enable the vertical position at which the exercise weight support device is suspended to be changed.

10. The exercise weight support device of claim 9, further comprising an inner frame disposed within the outer frame and to which the outer frame is slidably connected to enable the inner frame and the outer frame to move along a vertical path of travel relative to each other when the exercise weight support device is suspended by the belt, wherein:

the spool is rotatably mounted to the inner frame such that the axis about which the spool rotates remains at a fixed location relative to the inner frame; and the trigger handle is connected to the inner frame with a handle portion that is configured to enable a position of the trigger handle relative to the inner frame to be adjusted to accordingly enable the operating position and the non-operating position of the trigger handle relative to the outer frame to be adjusted.

11. The exercise weight support device of claim 10, wherein the ability to adjust the position of the trigger handle relative to the inner frame enables the non-operating position of the trigger handle to be adjusted to accommodate differing diameters of the bar of the free weight so that the trigger handle is at a distance from the bar that is close enough to allow tips of digits of a hand grasping the bar of the free weight to reach the trigger handle and pull the trigger handle closer toward the bar of the free weight and into the operating position of the trigger handle.

12. The exercise weight support device of claim 9, further comprising a torsion spring drivingly coupled to the spool to bias the spool toward rotating to wind more of the lower end of the belt onto the spool to cause the spool to tend to take up slack in the belt when the vertical position exercise weight support device is raised while the exercise weight support device is suspended by the belt.

13. The exercise weight support device of claim 9, further comprising at least one spring to bias the spool toward a position that causes the ratchet pawl and the teeth of the ratchet wheel to engage.

14. The exercise weight support device of claim 9, wherein exertion of the force of gravity on at least the outer frame is relied upon to bias the ratchet pawl toward a position that causes the ratchet pawl and the teeth of the ratchet wheel to engage.

15. The exercise weight support device of claim 9, wherein when the bar of the free weight is supported by the at least one of the cradle and the pair of hooks, the non-operating position of the trigger handle is at a distance from the bar of the free weight that is close enough to allow tips of digits of a hand grasping the bar of the free weight to reach the trigger handle and pull the trigger handle closer toward the bar of the free weight and into the operating position of the trigger handle.

16. The exercise weight support device of claim 9, further comprising:

an additional handle mounted to an exterior portion of the outer frame; and an additional trigger control that is also manually operable between an non-operating position of the additional trigger control that is close to the additional handle and an operating position of the additional trigger control that is closer still to the additional handle to move the spool relative to the ratchet pawl to also cause selective engagement of the ratchet pawl and the teeth of the ratchet wheel in lieu of manual operation of the trigger handle.

17. The exercise weight support device of claim 9, wherein an aperture is formed through an upper portion of the outer frame to allow passage of the lower end of the belt therethrough to be wound around the spool.

* * * * *